US010066622B2

(12) United States Patent
Pax et al.

(10) Patent No.: US 10,066,622 B2
(45) **Date of Patent: *Sep. 4, 2018**

(54) COMPRESSOR HAVING CAPACITY MODULATION SYSTEM

(71) Applicant: Emerson Climate Technologies, Inc., Sidney, OH (US)

(72) Inventors: Dennis D. Pax, Piqua, OH (US); Stephen Barry Tummino, Marysville, OH (US); Troy R. Brostrom, Lima, OH (US); Anthony Joseph Dahlinghaus, Sidney, OH (US); Brian R. Butler, Centerville, OH (US); Hua Xu, Jiangsu (CN); Mindy Lanzer, Anna, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/651,471

(22) Filed: Jul. 17, 2017

(65) Prior Publication Data

US 2017/0314558 A1 Nov. 2, 2017

Related U.S. Application Data

(63) Continuation of application No. PCT/CN2016/103763, filed on Oct. 28, 2016.

(Continued)

(30) Foreign Application Priority Data

Oct. 31, 2016 (CN) ..... 2016 1 0930347
Oct. 31, 2016 (CN) ..... 2016 2 1155252 U

(51) Int. Cl.
*F04C 18/00* (2006.01)
*F04C 18/02* (2006.01)

(Continued)

(52) U.S. Cl.
CPC ..... *F04C 18/0215* (2013.01); *F04C 18/0261* (2013.01); *F04C 27/005* (2013.01);

(Continued)

(58) Field of Classification Search
CPC ..... F04C 18/0215; F04C 18/0261; F04C 2240/30; F04C 23/008; F04C 27/005; F04C 28/16
See application file for complete search history.

(56) References Cited

U.S. PATENT DOCUMENTS 4,058,988 A 11/1977 Shaw
4,216,661 A 8/1980 Tojo et al.

(Continued)

FOREIGN PATENT DOCUMENTS

CN 1137614 A 12/1996
CN 1158944 A 9/1997

(Continued)

OTHER PUBLICATIONS

Office Action regarding U.S. Appl. No. 14/294,458, dated Sep. 21, 2017.

(Continued)

*Primary Examiner* — Mark Laurenzi
*Assistant Examiner* — Anthony Ayala Delgado
(74) *Attorney, Agent, or Firm* — Harness, Dickey & Pierce, P.L.C.

(57) ABSTRACT

A compressor may include first and second scrolls, a seal assembly and a valve ring. The first scroll may include a first end plate having a discharge passage, a modulation port, and a biasing passage. The modulation port may be in communication with a first pocket formed between spiral wraps of the first and second scrolls. The biasing passage may be in communication with a second pocket formed between spiral wraps of the first and second scrolls. The modulation valve (Continued)

ring is axially displaceable relative to the seal assembly and the first scroll between first and second positions. The valve ring may abut an end plate of the first scroll and close the modulation port when in the first position. The valve ring may abut an axially-facing surface of the seal assembly and is spaced apart from the end plate to open the modulation port when in the second position.

23 Claims, 12 Drawing Sheets

Related U.S. Application Data

(60) Provisional application No. 62/247,957, filed on Oct. 29, 2015, provisional application No. 62/247,967, filed on Oct. 29, 2015.

(51) Int. Cl.
*F04C 27/00* (2006.01)
*F04C 28/16* (2006.01)
*F04C 23/00* (2006.01)

(52) U.S. Cl.
CPC ..... *F04C 28/16* (2013.01); *F04C 23/008* (2013.01); *F04C 2240/30* (2013.01)

(56) References Cited

U.S. PATENT DOCUMENTS 4,382,370 A 5/1983 Suefuji et al.
4,383,805 A 5/1983 Teegarden et al.
4,389,171 A 6/1983 Eber et al.
4,475,360 A 10/1984 Suefuji et al.
4,497,615 A 2/1985 Griffith
4,545,742 A 10/1985 Schaefer
4,580,949 A 4/1986 Maruyama et al.
4,609,329 A 9/1986 Pillis et al.
4,696,630 A 9/1987 Sakata et al.
4,727,725 A 3/1988 Nagata et al.
4,774,816 A 10/1988 Uchikawa et al.
4,818,195 A 4/1989 Murayama et al.
4,846,633 A 7/1989 Suzuki et al.
4,877,382 A 10/1989 Caillat et al.
4,886,425 A 12/1989 Itahana et al.
4,940,395 A 7/1990 Yamamoto et al.
5,040,952 A 8/1991 Inoue et al.
5,055,010 A 10/1991 Logan
5,059,098 A 10/1991 Suzuki et al.
5,071,323 A 12/1991 Sakashita et al.
5,074,760 A 12/1991 Hirooka et al.
5,080,056 A 1/1992 Kramer et al.
5,085,565 A 2/1992 Barito
RE34,148 E 12/1992 Terauchi et al.
5,169,294 A 12/1992 Barito
5,192,195 A 3/1993 Iio et al.
5,193,987 A 3/1993 Iio et al.
5,240,389 A 8/1993 Oikawa et al.
5,253,489 A 10/1993 Yoshii
5,356,271 A 10/1994 Miura et al.
5,451,146 A 9/1995 Inagaki et al.
5,482,637 A 1/1996 Rao et al.
5,551,846 A 9/1996 Taylor et al.
5,557,897 A 9/1996 Kranz et al.
5,562,426 A 10/1996 Watanabe et al.
5,577,897 A 11/1996 Inagaki et al.
5,607,288 A 3/1997 Wallis et al.
5,611,674 A 3/1997 Bass et al.
5,613,841 A 3/1997 Bass et al.
5,639,225 A 6/1997 Matsuda et al.
5,640,854 A 6/1997 Fogt et al.
5,674,058 A 10/1997 Matsuda et al.
5,678,985 A 10/1997 Brooke et al.
5,707,210 A 1/1998 Ramsey et al.
5,722,257 A 3/1998 Ishii et al.
5,741,120 A 4/1998 Bass et al.
5,855,475 A 1/1999 Fujio et al.
5,885,063 A 3/1999 Makino et al.
5,993,171 A 11/1999 Higashiyama
5,993,177 A 11/1999 Terauchi et al.
6,047,557 A 4/2000 Pham et al.
6,086,335 A 7/2000 Bass et al.
6,095,765 A 8/2000 Khalifa
6,102,671 A 8/2000 Yamamoto et al.
6,123,517 A 9/2000 Brooke et al.
6,123,528 A 9/2000 Sun et al.
6,132,179 A 10/2000 Higashiyama
6,139,287 A 10/2000 Kuroiwa et al.
6,139,291 A 10/2000 Perevozchikov
6,149,401 A 11/2000 Iwanami et al.
6,164,940 A 12/2000 Terauchi et al.
6,176,686 B1 1/2001 Wallis et al.
6,179,589 B1 1/2001 Bass et al.
6,202,438 B1 3/2001 Barito
6,210,120 B1 4/2001 Hugenroth et al.
6,213,731 B1 4/2001 Doepker et al.
6,231,316 B1 5/2001 Wakisaka et al.
6,273,691 B1 8/2001 Morimoto et al.
6,293,767 B1 9/2001 Bass
6,293,776 B1 9/2001 Hahn et al.
6,322,340 B1 11/2001 Itoh et al.
6,350,111 B1 2/2002 Perevozchikov et al.
6,379,123 B1 4/2002 Makino et al.
6,412,293 B1 7/2002 Pham et al.
6,413,058 B1 7/2002 Williams et al.
6,419,457 B1 7/2002 Seibel et al.
6,428,286 B1 8/2002 Shimizu et al.
6,454,551 B2 9/2002 Kuroki et al.
6,457,948 B1 10/2002 Pham
6,464,481 B2 10/2002 Tsubai et al.
6,478,550 B2 11/2002 Matsuba et al.
6,506,036 B2 1/2003 Tsubai et al.
6,537,043 B1 3/2003 Chen
6,544,016 B2 4/2003 Gennami et al.
6,558,143 B2 5/2003 Nakajima et al.
6,589,035 B1 7/2003 Tsubono et al.
6,679,683 B2 1/2004 Seibel et al.
6,715,999 B2 4/2004 Ancef et al.
6,769,881 B2 8/2004 Lee
6,769,888 B2 8/2004 Tsubono et al.
6,773,242 B1 8/2004 Perevozchikov
6,817,847 B2 11/2004 Agner
6,821,092 B1 11/2004 Gehret et al.
6,863,510 B2 3/2005 Cho
6,881,046 B2 4/2005 Shibamoto et al.
6,884,042 B2 4/2005 Zili et al.
6,893,229 B2 5/2005 Choi et al.
6,896,498 B1 5/2005 Patel
6,913,448 B2 7/2005 Liang et al.
6,984,114 B2 1/2006 Zili et al.
7,018,180 B2 3/2006 Koo
7,029,251 B2 4/2006 Chang et al.
7,118,358 B2 10/2006 Tsubono et al.
7,137,796 B2 11/2006 Tsubono et al.
7,160,088 B2 1/2007 Peyton
7,207,787 B2 4/2007 Liang et al.
7,229,261 B2 6/2007 Morimoto et al.
7,255,542 B2 8/2007 Lifson et al.
7,261,527 B2 8/2007 Alexander et al.
7,311,740 B2 12/2007 Williams et al.
7,344,365 B2 3/2008 Takeuchi et al.
RE40,257 E 4/2008 Doepker et al.
7,354,259 B2 4/2008 Tsubono et al.
7,364,416 B2 4/2008 Liang et al.
7,371,057 B2 5/2008 Shin et al.
RE40,399 E 6/2008 Hugenroth et al.
RE40,400 E 6/2008 Bass et al.
7,393,190 B2 7/2008 Lee et al.
7,404,706 B2 7/2008 Ishikawa et al.
RE40,554 E 10/2008 Bass et al.
7,510,382 B2 3/2009 Jeong
7,547,202 B2 6/2009 Knapke
7,695,257 B2 4/2010 Joo et al.

(56) References Cited

U.S. PATENT DOCUMENTS

| | | | |
|---|---|---|---|
| 7,717,687 | B2 | 5/2010 | Reinhart |
| 7,771,178 | B2 | 8/2010 | Perevozchikov et al. |
| 7,802,972 | B2 | 9/2010 | Shimizu et al. |
| 7,815,423 | B2 | 10/2010 | Guo et al. |
| 7,891,961 | B2 | 2/2011 | Shimizu et al. |
| RE42,371 | E | 5/2011 | Peyton |
| 7,967,582 | B2 | 6/2011 | Akei et al. |
| 7,967,583 | B2 | 6/2011 | Stover et al. |
| 7,972,125 | B2 | 7/2011 | Stover et al. |
| 7,976,289 | B2 | 7/2011 | Masao |
| 7,976,295 | B2 * | 7/2011 | Stover ..... F04C 28/265 417/299 |
| 7,988,433 | B2 | 8/2011 | Akei et al. |
| 8,025,492 | B2 | 9/2011 | Seibel et al. |
| 8,303,278 | B2 | 11/2012 | Roof et al. |
| 8,303,279 | B2 | 11/2012 | Hahn |
| 8,308,448 | B2 | 11/2012 | Fields et al. |
| 8,328,531 | B2 | 12/2012 | Milliff et al. |
| 8,506,271 | B2 | 8/2013 | Seibel et al. |
| 8,517,703 | B2 | 8/2013 | Doepker |
| 8,585,382 | B2 | 11/2013 | Akei et al. |
| 8,616,014 | B2 | 12/2013 | Stover et al. |
| 8,790,098 | B2 | 7/2014 | Stover et al. |
| 8,840,384 | B2 | 9/2014 | Patel et al. |
| 8,857,200 | B2 | 10/2014 | Stover et al. |
| 8,932,036 | B2 | 1/2015 | Monnier et al. |
| 9,127,677 | B2 | 9/2015 | Doepker |
| 9,145,891 | B2 | 9/2015 | Kim et al. |
| 9,249,802 | B2 | 2/2016 | Doepker et al. |
| 9,303,642 | B2 | 4/2016 | Akei et al. |
| 9,435,340 | B2 | 9/2016 | Doepker et al. |
| 9,494,157 | B2 | 11/2016 | Doepker |
| 9,605,677 | B2 | 3/2017 | Heidecker et al. |
| 9,651,043 | B2 | 5/2017 | Stover et al. |
| 9,777,730 | B2 | 10/2017 | Doepker et al. |
| 9,790,940 | B2 | 10/2017 | Doepker et al. |
| 9,879,674 | B2 | 1/2018 | Akei et al. |
| 2001/0010800 | A1 | 8/2001 | Kohsokabe et al. |
| 2002/0039540 | A1 | 4/2002 | Kuroki et al. |
| 2003/0044296 | A1 | 3/2003 | Chen |
| 2003/0186060 | A1 | 10/2003 | Rao |
| 2003/0228235 | A1 | 12/2003 | Sowa et al. |
| 2004/0136854 | A1 | 7/2004 | Kimura et al. |
| 2004/0146419 | A1 | 7/2004 | Kawaguchi et al. |
| 2004/0184932 | A1 | 9/2004 | Lifson |
| 2004/0197204 | A1 | 10/2004 | Yamanouchi et al. |
| 2005/0019177 | A1 | 1/2005 | Shin et al. |
| 2005/0019178 | A1 | 1/2005 | Shin et al. |
| 2005/0053507 | A1 | 3/2005 | Takeuchi et al. |
| 2005/0069444 | A1 | 3/2005 | Peyton |
| 2005/0201883 | A1 | 9/2005 | Clendenin et al. |
| 2005/0214148 | A1 | 9/2005 | Ogawa et al. |
| 2006/0099098 | A1 | 5/2006 | Lee et al. |
| 2006/0198748 | A1 | 9/2006 | Grassbaugh et al. |
| 2006/0228243 | A1 | 10/2006 | Sun et al. |
| 2006/0233657 | A1 | 10/2006 | Bonear et al. |
| 2007/0036661 | A1 | 2/2007 | Stover |
| 2007/0110604 | A1 | 5/2007 | Peyton |
| 2007/0130973 | A1 | 6/2007 | Lifson et al. |
| 2008/0138227 | A1 | 6/2008 | Knapke |
| 2008/0159892 | A1 | 7/2008 | Huang et al. |
| 2008/0159893 | A1 | 7/2008 | Caillat |
| 2008/0196445 | A1 | 8/2008 | Lifson et al. |
| 2008/0223057 | A1 | 9/2008 | Lifson et al. |
| 2008/0305270 | A1 | 12/2008 | Uhlianuk et al. |
| 2009/0035167 | A1 | 2/2009 | Sun |
| 2009/0068048 | A1 | 3/2009 | Stover et al. |
| 2009/0071183 | A1 | 3/2009 | Stover et al. |
| 2009/0185935 | A1 | 7/2009 | Seibel et al. |
| 2009/0297377 | A1 | 12/2009 | Stover et al. |
| 2009/0297378 | A1 | 12/2009 | Stover et al. |
| 2009/0297379 | A1 | 12/2009 | Stover et al. |
| 2009/0297380 | A1 | 12/2009 | Stover et al. |
| 2010/0111741 | A1 | 5/2010 | Chikano et al. |
| 2010/0135836 | A1 | 6/2010 | Stover et al. |
| 2010/0158731 | A1 | 6/2010 | Akei et al. |
| 2010/0212311 | A1 | 8/2010 | McQuary et al. |
| 2010/0254841 | A1 | 10/2010 | Akei et al. |
| 2010/0300659 | A1 | 12/2010 | Stover et al. |
| 2010/0303659 | A1 | 12/2010 | Stover et al. |
| 2011/0135509 | A1 | 6/2011 | Fields et al. |
| 2011/0206548 | A1 | 8/2011 | Doepker |
| 2011/0293456 | A1 | 12/2011 | Seibel et al. |
| 2012/0107163 | A1 | 5/2012 | Monnier et al. |
| 2013/0078128 | A1 | 3/2013 | Akei |
| 2013/0121857 | A1 | 5/2013 | Liang et al. |
| 2013/0309118 | A1 | 11/2013 | Ginies et al. |
| 2013/0315768 | A1 | 11/2013 | Le Coat et al. |
| 2014/0023540 | A1 | 1/2014 | Heidecker et al. |
| 2014/0024563 | A1 | 1/2014 | Heidecker et al. |
| 2014/0037486 | A1 | 2/2014 | Stover et al. |
| 2014/0134030 | A1 | 5/2014 | Stover et al. |
| 2014/0134031 | A1 | 5/2014 | Doepker et al. |
| 2014/0147294 | A1 | 5/2014 | Fargo et al. |
| 2014/0154121 | A1 | 6/2014 | Doepker |
| 2014/0154124 | A1 | 6/2014 | Doepker et al. |
| 2015/0192121 | A1 | 7/2015 | Sung et al. |
| 2015/0330386 | A1 | 11/2015 | Doepker |
| 2015/0345493 | A1 | 12/2015 | Lochner et al. |
| 2015/0354719 | A1 | 12/2015 | van Beek et al. |
| 2016/0115954 | A1 | 4/2016 | Doepker et al. |
| 2017/0002817 | A1 | 1/2017 | Stover |
| 2017/0002818 | A1 | 1/2017 | Stover |
| 2017/0030354 | A1 | 2/2017 | Stover |
| 2017/0268510 | A1 | 9/2017 | Stover et al. |
| 2017/0306960 | A1 | 10/2017 | Pax et al. |
| 2018/0038369 | A1 | 2/2018 | Doepker et al. |
| 2018/0038370 | A1 | 2/2018 | Doepker et al. |

FOREIGN PATENT DOCUMENTS

| | | | |
|---|---|---|---|
| CN | 1158945 | A | 9/1997 |
| CN | 1289011 | A | 3/2001 |
| CN | 1349053 | A | 5/2002 |
| CN | 1382912 | A | 12/2002 |
| CN | 1517553 | A | 8/2004 |
| CN | 1680720 | A | 10/2005 |
| CN | 1702328 | A | 11/2005 |
| CN | 2747381 | Y | 12/2005 |
| CN | 1828022 | A | 9/2006 |
| CN | 1963214 | A | 5/2007 |
| CN | 1995756 | A | 7/2007 |
| CN | 101358592 | A | 2/2009 |
| CN | 101761479 | A | 6/2010 |
| CN | 101806302 | A | 8/2010 |
| CN | 101910637 | A | 12/2010 |
| CN | 102076963 | A | 5/2011 |
| CN | 102089525 | A | 6/2011 |
| CN | 102272454 | A | 12/2011 |
| CN | 102422024 | A | 4/2012 |
| CN | 102449314 | A | 5/2012 |
| CN | 102762866 | A | 10/2012 |
| CN | 202926640 | U | 5/2013 |
| CN | 103502644 | A | 1/2014 |
| CN | 204041454 | U | 12/2014 |
| CN | 104838143 | A | 8/2015 |
| CN | 205533207 | U | 8/2016 |
| CN | 205876712 | U | 1/2017 |
| CN | 205876713 | U | 1/2017 |
| CN | 205895597 | U | 1/2017 |
| EP | 0822335 | A2 | 2/1998 |
| EP | 1067289 | A2 | 1/2001 |
| EP | 1087142 | A2 | 3/2001 |
| EP | 1182353 | A1 | 2/2002 |
| EP | 1241417 | A1 | 9/2002 |
| EP | 1371851 | A2 | 12/2003 |
| EP | 1382854 | A2 | 1/2004 |
| EP | 2151577 | A1 | 2/2010 |
| GB | 2107829 | A | 5/1983 |
| JP | 60259794 | | 12/1985 |
| JP | S6385277 | A | 4/1988 |
| JP | 63-205482 | | 8/1988 |
| JP | H0281982 | A | 3/1990 |
| JP | 03081588 | A | 4/1991 |

(56) References Cited

FOREIGN PATENT DOCUMENTS

| | | | |
|---|---|---|---|
| JP | H04272490 | A | 9/1992 |
| JP | H07-293456 | A | 11/1995 |
| JP | H08247053 | A | 9/1996 |
| JP | 08334094 | A | 12/1996 |
| JP | H8320079 | A | 12/1996 |
| JP | H09-177689 | A | 7/1997 |
| JP | 11107950 | | 4/1999 |
| JP | H11324950 | A | 11/1999 |
| JP | 2000104684 | A | 4/2000 |
| JP | 2000161263 | A | 6/2000 |
| JP | 2000329078 | A | 11/2000 |
| JP | 2003074481 | A | 3/2003 |
| JP | 2003074482 | A | 3/2003 |
| JP | 2003106258 | A | 4/2003 |
| JP | 2003227479 | A | 8/2003 |
| JP | 2007154761 | A | 6/2007 |
| JP | 2008248775 | A | 10/2008 |
| JP | 2013167215 | A | 8/2013 |
| KR | 1019870000015 | | 5/1985 |
| KR | 870000015 | B1 | 1/1987 |
| KR | 20050027402 | A | 3/2005 |
| KR | 20050095246 | A | 9/2005 |
| KR | 100547323 | B1 | 1/2006 |
| KR | 20100017008 | A | 2/2010 |
| KR | 101192642 | B1 | 10/2012 |
| WO | WO-0073659 | A1 | 12/2000 |
| WO | WO-2007046810 | A2 | 4/2007 |
| WO | WO-2009017741 | A1 | 2/2009 |
| WO | WO-2009155099 | A2 | 12/2009 |
| WO | WO-2010118140 | A2 | 10/2010 |
| WO | WO-2012114455 | A1 | 8/2012 |

OTHER PUBLICATIONS

Office Action regarding U.S. Appl. No. 14/757,407, dated Oct. 13, 2017.
Office Action regarding Chinese Patent Application No. 201410460792.0, dated Nov. 1, 2017. Translation provided by Unitalen Attorneys at Law.
International Search Report regarding International Application No. PCT/CN2016/103763, dated Jan. 25, 2017.
Written Opinion of the International Searching Authority regarding International Application No. PCT/CN2016/103763, dated Jan. 25, 2017.
Written Opinion of the International Searching Authority regarding Application No. PCT/US2010/030248, dated Nov. 26, 2010.
International Search Report regarding Application No. PCT/US2010/030248, dated Nov. 26, 2010.
International Search Report regarding Application No. PCT/US2011/025921, dated Oct. 7, 2011.
Written Opinion of the International Search Authority regarding Application No. PCT/US2011/025921, dated Oct. 7, 2011.
U.S. Office Action regarding U.S. Appl. No. 13/181,065 dated Nov. 9, 2012.
U.S. Appl. No. 13/948,458, filed Jul. 23, 2013.
U.S. Appl. No. 13/948,653, filed Jul. 23, 2013.
U.S. Appl. No. 14/073,246, filed Nov. 6, 2013.
U.S. Appl. No. 14/073,293, filed Nov. 6, 2013.
International Search Report regarding Application No. PCT/US2013/051678, dated Oct. 21, 2013.
Written Opinion of the International Searching Authority regarding Application No. PCT/US2013/051678, dated Oct. 21, 2013.
U.S. Appl. No. 14/060,240, filed Oct. 22, 2013.
U.S. Office Action regarding U.S. Appl. No. 11/645,288 dated Nov. 30, 2009.
Extended European Search Report regarding Application No. EP07254962 dated Mar. 12, 2008.
First China Office Action regarding Application No. 200710160038.5 dated Jul. 8, 2010. Translation provided by Unitalen Attorneys at Law.
China Office Action regarding Application No. 200710160038.5 dated Jan. 31, 2012. Translation provided by Unitalen Attorneys At Law.
China Office Action regarding Application No. 201080020243.1 dated Nov. 5, 2013. Translation provided by Unitalen Attorneys At Law.
International Search Report regarding Application No. PCT/US2013/069462, dated Feb. 21, 2014.
Written Opinion of the Internation Searching Authority regarding Application No. PCT/US2013/069462, dated Feb. 21, 2014.
International Search Report regarding Application No. PCT/US2013/070981, dated Mar. 4, 2014.
Written Opinion of the International Searching Authority regarding Application No. PCT/US2013/070981, dated Mar. 4, 2014.
International Search Report regarding Application No. PCT/US2013/069456, dated Feb. 18, 2014.
Written Opinion of the International Searching Authority regarding Application No. PCT/US2013/069456, dated Feb. 18, 2014.
International Search Report regarding Application No. PCT/US2013/070992, dated Feb. 25, 2014.
Written Opinion of the International Searching Authority regarding Application No. PCT/US2013/070992, dated Feb. 25, 2014.
Second Office Action regarding China Application No. 201180010366.1 dated Dec. 31, 2014. Translation provided by Unitalen Attorneys at Law.
Office Action regarding U.S. Appl. No. 14/081,390, dated Mar. 27, 2015.
U.S. Appl. No. 14/060,102, filed Oct. 22, 2013.
Search Report regarding European Patent Application No. 10762374.6-1608 / 2417356 PCT/US2010030248, dated Jun. 16, 2015.
Office Action regarding U.S. Appl. No. 14/060,240, dated Aug. 12, 2015.
International Search Report regarding International Application No. PCT/US2015/033960, dated Sep. 1, 2015.
Written Opinion of the International Searching Authority regarding International Application No. PCT/US2015/033960, dated Sep. 1, 2015.
Office Action regarding U.S. Appl. No. 14/073,293, dated Sep. 25, 2015.
Restriction Requirement regarding U.S. Appl. No. 14/060,102, dated Oct. 7, 2015.
Interview Summary regarding U.S. Appl. No. 14/060,240, dated Dec. 1, 2015.
Office Action regarding Chinese Patent Application No. 201410461048.2, dated Nov. 30, 2015. Translation provided by Unitalen Attorneys at Law.
Office Action regarding U.S. Appl. No. 14/073,293, dated Jan. 29, 2016.
Restriction Requirement regarding U.S. Appl. No. 14/060,102, dated Mar. 16, 2016.
Office Action regarding Chinese Patent Application No. 201410460792.0, dated Feb. 25, 2016. Translation provided by Unitalen Attorneys at Law.
Advisory Action regarding U.S. Appl. No. 14/073,293, dated Apr. 18, 2016.
First Office Action regarding Chinese application No. 201380059666.8, dated Apr. 5, 2016. Translation provided by Unitalen Attorneys at Law.
First Office Action regarding Chinese application No. 201380062614.6, dated Apr. 5, 2016. Translation provided by Unitalen Attorneys at Law.
Office Action regarding Chinese Patent Application No. 201380062657.4, dated May 4, 2016. Translation provided by Unitalen Attorneys at Law.
Office Action regarding Chinese Patent Application No. 201380059963.2, dated May 10, 2016. Translation provided by Unitalent Attorneys at Law.
Office Action regarding U.S. Appl. No. 14/060,102, dated Jun. 14, 2016.
Office Action regarding U.S. Appl. No. 14/846,877, dated Jul. 15, 2016.

(56) References Cited

OTHER PUBLICATIONS

Office Action regarding Chinese Patent Application No. 201410461048.2, dated Jul. 26, 2016. Translation provided by Unitalen Attorneys at Law.
Search Report regarding European Patent Application No. 13858194.7, dated Aug. 3, 2016.
Search Report regarding European Patent Application No. 13859308.2, dated Aug. 3, 2016.
Office Action regarding U.S. Appl. No. 14/294,458, dated Aug. 19, 2016.
Office Action regarding Chinese Patent Application No. 201410460792.0, dated Oct. 21, 2016. Translation provided by Unitalen Attorneys at Law.
Search Report regarding European Patent Application No. 11747996.4, dated Nov. 7, 2016.
Office Action regarding Chinese Patent Application No. 201380059666.8, dated Nov. 23, 2016. Translation provided by Unitalen Attorneys at Law.
Office Action regarding U.S. Appl. No. 14/060,102, dated Dec. 28, 2016.
Office Action regarding U.S. Appl. No. 15/156,400, dated Feb. 23, 2017.
Office Action regarding U.S. Appl. No. 14/294,458, dated Feb. 28, 2017.
Advisory Action regarding U.S. Appl. No. 14/060,102, dated Mar. 3, 2017.
Office Action regarding U.S. Appl. No. 14/663,073, dated Apr. 11, 2017.
Office Action regarding Chinese Patent Application No. 201410460792.0, dated Apr. 24, 2017. Translation provided by Unitalen Attorneys at Law.
Office Action regarding U.S. Appl. No. 14/946,824, dated May 10, 2017.
Advisory Action regarding U.S. Appl. No. 14/294,458, dated Jun. 9, 2017.
Office Action regarding Chinese Patent Application No. 201610703191.7, dated Jun. 13, 2017. Translation provided by Unitalen Attorneys at Law.
Office Action regarding Indian Patent Application No. 2043/MUMNP/2011, dated Jul. 28, 2017.
U.S. Appl. No. 15/881,016, filed Jan. 26, 2018, Masao Akei et al.
Office Action regarding Chinese Patent Application No. 201610158216.X, dated Oct. 30, 2017. Translation provided by Unitalen Attorneys at Law.
Office Action regarding Chinese Patent Application No. 201610512702.7, dated Dec. 20, 2017. Partial translation provided by Unitalen Attorneys at Law.
Office Action regarding Chinese Patent Application No. 201610499158.7, dated Jan. 9, 2018. Translation provided by Unitalen Attorneys at Law.
Office Action regarding Chinese Patent Application No. 201580029636.1, dated Jan. 17, 2018. Translation provided by Unitalen Attorneys at Law.
Office Action regarding U.S. Appl. No. 15/646,654, dated Feb. 9, 2018.
Office Action regarding Indian Patent Application No. 1907/MUMNP/2012, dated Feb. 26, 2018.
Election Requirement regarding U.S. Appl. No. 15/186,092, dated Apr. 3, 2018.
Election Requirement regarding U.S. Appl. No. 15/784,458, dated Apr. 5, 2018.
Non-Final Office Action regarding U.S. Appl. No. 15/186,151, dated May 3, 2018.

* cited by examiner

COMPRESSOR HAVING CAPACITY MODULATION SYSTEM

CROSS-REFERENCE TO RELATED APPLICATIONS

This application is a continuation of International Application No. PCT/CN2016/103763, filed Oct. 28, 2016, which claims priority to U.S. Provisional Application No. 62/247,967, filed Oct. 29, 2015, and U.S. Provisional Application No. 62/247,957, filed Oct. 29, 2015. This application also claims priority to CN201621155252.2, filed Oct. 31, 2016, and CN201610930347.5, filed Oct. 31, 2016. The entire disclosures of each of the above applications are incorporated herein by reference.

FIELD

The present disclosure relates to a compressor having a capacity modulation system.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a compressor that may include a shell assembly, first and second scroll members, a floating seal assembly and a modulation valve ring. The shell assembly may define a suction-pressure region and a discharge-pressure region. The shell assembly may include a partition separating the suction-pressure region from the discharge-pressure region. The first scroll member may be disposed within the shell assembly and may include a first end plate having a discharge passage, a modulation port, a biasing passage, and a first spiral wrap extending from the first end plate. The second scroll member may be disposed within the shell assembly and may include a second end plate having a second spiral wrap extending therefrom. The first and second spiral wraps meshingly engage each other and form a series of pockets during orbital displacement of the second scroll member relative to the first scroll member. The modulation port may be in communication with a first one of the pockets. The biasing passage may be in communication with a second one of the pockets. The floating seal assembly may be engaged with the partition and the first scroll member and may isolate the discharge-pressure region from the suction-pressure region. The modulation valve ring may be located axially between the floating seal assembly and the first end plate and may be in sealing engagement with an outer radial surface of a hub extending from the first end plate and an outer radial surface of the floating seal assembly to define an axial biasing chamber in fluid communication with the biasing passage. The modulation valve ring may be axially displaceable between first and second positions. The modulation valve ring may abut the first end plate and close the modulation port when in the first position. The modulation valve ring may abut an axially-facing surface of the floating seal assembly and may be spaced apart from the first end plate to open the modulation port when in the second position.

The port may be located at a first wrap angle from a suction seal-off location, and the biasing passage is located at a second wrap angle from the suction seal-off location. In some configurations, a ratio of the first angle to the second angle may be between 0.65 and 0.75.

In some configurations, the modulation valve ring urges the floating seal assembly axially against the partition when the modulation valve ring is in the second position.

In some configurations, the compressor includes a modulation lift ring located axially between the modulation valve ring and the first end plate and in sealing engagement with the modulation valve ring to define a modulation control chamber between the modulation valve ring and the modulation lift ring.

In some configurations, the compressor may include a modulation control valve assembly operable in first and second modes and in fluid communication with the modulation control chamber. The modulation control valve assembly may control an operating pressure within the modulation control chamber and may provide a first pressure within the modulation control chamber when operated in the first mode to displace the modulation valve ring to the first position and operate the compressor in the full capacity mode. The modulation control valve assembly may provide a second pressure within the modulation control chamber greater than the first pressure when operated in the second mode to displace the modulation valve ring to the second position and operate the compressor in the partial capacity mode.

In some configurations, a radially extending passage is formed axially between the modulation valve ring and the first end plate when the modulation valve ring is in the second position. The radially extending passage may be in communication with the modulation port.

In some configurations, the radially extending passage extends between the modulation lift ring and the first end plate.

In some configurations, the modulation lift ring includes a U-shaped seal engaging first and second annular walls of the modulation valve ring.

In some configurations, the U-shaped seal is a single, unitary body formed from a polymeric material.

In some configurations, the modulation lift ring includes a base ring disposed axially between the U-shaped seal and the first end plate. The base ring may include a plurality of axially extending bosses contacting the first end plate.

In some configurations, the U-shaped seal includes a base portion and a pair of lips formed integrally with the base portion. The base portion may extend perpendicular relative to a driveshaft rotational axis. One of the lips extends from a radially outer edge of the base portion and another of the lips extends from a radially inner edge of the base portion.

In another form, the present disclosure provides a compressor that may include first and second scroll members, a seal assembly and a valve ring. The first scroll member includes a first end plate having a discharge passage, a port, a biasing passage, and a first spiral wrap extending from the first end plate. The second scroll member includes a second end plate having a second spiral wrap extending therefrom. The first and second spiral wraps meshingly engage each other and form a series of pockets therebetween. The port may be in selective communication with one of the pockets. The biasing passage may be in communication with one of the pockets. The seal assembly may be engaged with the first scroll member and a partition defining a discharge chamber of the compressor. The valve ring may be located axially between the seal assembly and the first end plate and may cooperate with the seal assembly to define an axial biasing chamber in fluid communication with the biasing passage. The valve ring may be movable between a first position in which the valve ring abuts the first end plate and closes the port and a second position in which the valve ring is spaced apart from the first end plate to open the port.

The port may be located at a first wrap angle from a suction seal-off location, and the biasing passage is located at a second wrap angle from the suction seal-off location. In some configurations, a ratio of the first angle to the second angle may be between 0.65 and 0.75.

In another form, the present disclosure provides a compressor that may include a shell assembly, first and second scroll members, a floating seal assembly and a modulation valve ring. The shell assembly may define a suction-pressure region and a discharge-pressure region. The shell assembly may include a partition separating the suction-pressure region from the discharge-pressure region. The first scroll member may be disposed within the shell assembly and may include a first end plate having a discharge passage, a modulation port, a biasing passage, and a first spiral wrap extending from the first end plate. The second scroll member may be disposed within the shell assembly and may include a second end plate having a second spiral wrap extending therefrom. The first and second spiral wraps meshingly engage each other and form a series of pockets during orbital displacement of the second scroll member relative to the first scroll member. The modulation port may be in communication with a first one of the pockets. The biasing passage may be in communication with a second one of the pockets. The floating seal assembly may be engaged with the partition and the first scroll member and may isolate the discharge-pressure region from the suction-pressure region. The modulation valve ring may be located axially between the floating seal assembly and the first end plate and may be in sealing engagement with an outer radial surface of a hub extending from the first end plate and an outer radial surface of the floating seal assembly to define an axial biasing chamber in fluid communication with the biasing passage. The modulation valve ring may be axially displaceable between first and second positions. In the first position, the modulation valve ring may abut the first end plate and close the modulation port. In the second position, the modulation valve ring may be spaced apart from the first end plate to open the modulation port. The modulation lift ring may be located axially between the modulation valve ring and the first end plate and in sealing engagement with the modulation valve ring to define a modulation control chamber between the modulation valve ring and the modulation lift ring. The modulation lift ring may include a seal having a U-shaped cross section formed from a polymeric material and engaging first and second annular walls of the modulation valve ring.

In some configurations, the U-shaped cross section includes a base portion and a pair of lips formed integrally with the base portion. The base portion may extend perpendicular relative to a driveshaft rotational axis. One of the lips extends from a radially outer edge of the base portion, and another of the lips extends from a radially inner edge of the base portion.

In some configurations, the one of the lips extending from the radially inner edge of the base portion extends further from the base portion in an axial direction than the one of the lips extending from the radially outer edge of the base portion.

In some configurations, the modulation lift ring includes a base ring disposed axially between the U-shaped cross section and the first end plate. The base ring may include a plurality of axially extending bosses contacting the first end plate.

In some configurations, the first end plate includes a plurality of axially extending bosses integrally formed with the first end plate and contacting the modulation lift ring to define a radially extending passage in communication with the modulation port.

In another form, the present disclosure provides a compressor that may include first and second scroll members, a seal assembly, a valve ring, and a lift ring. The first scroll member may include a first end plate having a discharge passage, a port, a biasing passage, and a first spiral wrap extending from the first end plate. The second scroll member may include a second end plate having a second spiral wrap extending therefrom. The first and second spiral wraps may be meshingly engaged with each other and form a series of pockets therebetween. The port may be in selective communication with one of the pockets. The biasing passage may be in communication with one of the pockets. The seal assembly may be engaged with the first scroll member and a partition defining a discharge chamber of the compressor. The valve ring may be located axially between the seal assembly and the first end plate and may cooperate with the seal assembly to define an axial biasing chamber in fluid communication with the biasing passage. The valve ring may be movable between a first position in which the valve ring abuts the first end plate and closes the port and a second position in which the valve ring is spaced apart from the first end plate to open the port. The lift ring may be at least partially disposed within an annular recess in the valve ring and in sealing engagement with the valve ring to define a control chamber between the valve ring and the lift ring. The lift ring may include a base ring having a plurality of bosses contacting the first end plate. The base ring may include an annular main body from which the bosses extend. The main body may be at least partially received within the annular recess. Each of at least two of the bosses may include a flange portion that extends radially outward relative to an outer diametrical surface of the main body and radially outward relative to the annular recess.

In some configurations, the first end plate includes a first annular surface, a second annular surface, and an annular step disposed between the first and second annular surfaces. The valve ring may contact the first annular surface when the valve ring is in the first position. The bosses may contact the second annular surface.

In some configurations, an axial thickness of the flange portion is less than an axial thickness of the annular step. An inner diameter of the main body may be less than a diameter of the annular step.

In some configurations, the lift ring includes a seal having a U-shaped cross section formed from a polymeric material and engaging first and second annular walls of the valve ring.

In another form, the present disclosure provides a compressor that may include a shell assembly, first and second scroll members, a floating seal assembly, and a modulation valve ring. The shell assembly may define a suction-pressure region and a discharge-pressure region. The shell assembly may include a partition separating the suction-pressure region from the discharge-pressure region. The first scroll member may be disposed within the shell assembly and may include a first end plate having a discharge passage, a modulation port, a biasing passage, and a first spiral wrap extending from the first end plate. The second scroll member may be disposed within the shell assembly and may include a second end plate having a second spiral wrap extending therefrom. The first and second spiral wraps are meshingly engaged and form a series of pockets during orbital displacement of the second scroll member relative to the first scroll member. The modulation port may be in communication with a first one of the pockets. The biasing passage may be in communication with a second one of the pockets. The floating seal assembly may be engaged with the partition and the first scroll member and may isolate the discharge-pressure region from the suction-pressure region. The modulation valve ring may be located axially between the floating seal assembly and the first end plate and may be in sealing engagement with an outer radial surface of a hub extending from the first end plate and an outer radial surface of the floating seal assembly to define an axial biasing chamber in fluid communication with the biasing passage. The modulation valve ring may be axially displaceable between first and second positions. The modulation valve ring may abut the first end plate and close the modulation port when in the first position. The modulation valve ring may abut an axially-facing surface of the floating seal assembly and may be spaced apart from the first end plate to open the modulation port when in the second position. The modulation port may be located at a first wrap angle from a suction seal-off location. The biasing passage may be located at a second wrap angle from the suction seal-off location. A ratio of the first angle to the second angle may be between 0.65 and 0.75.

In another form, the present disclosure provides a compressor that may include first and second scroll members, a seal assembly, and a valve ring. The first scroll member may include a first end plate having a discharge passage, a port, a biasing passage, and a first spiral wrap extending from the first end plate. The second scroll member may include a second end plate having a second spiral wrap extending therefrom. The first and second spiral wraps are meshingly engaged and form a series of pockets therebetween. The port may be in selective communication with one of the pockets. The biasing passage may be in communication with one of the pockets. The seal assembly may be engaged with the first scroll member and a partition defining a discharge chamber of the compressor. The valve ring may be located axially between the seal assembly and the first end plate and may cooperate with the seal assembly to define an axial biasing chamber in fluid communication with the biasing passage. The valve ring may be movable between a first position in which the valve ring abuts the first end plate and closes the port and a second position in which the valve ring is spaced apart from the first end plate to open the port. The port may be located at a first wrap angle from a suction seal-off location. The biasing passage may be located at a second wrap angle from the suction seal-off location. A ratio of the first angle to the second angle may be between 0.65 and 0.75.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
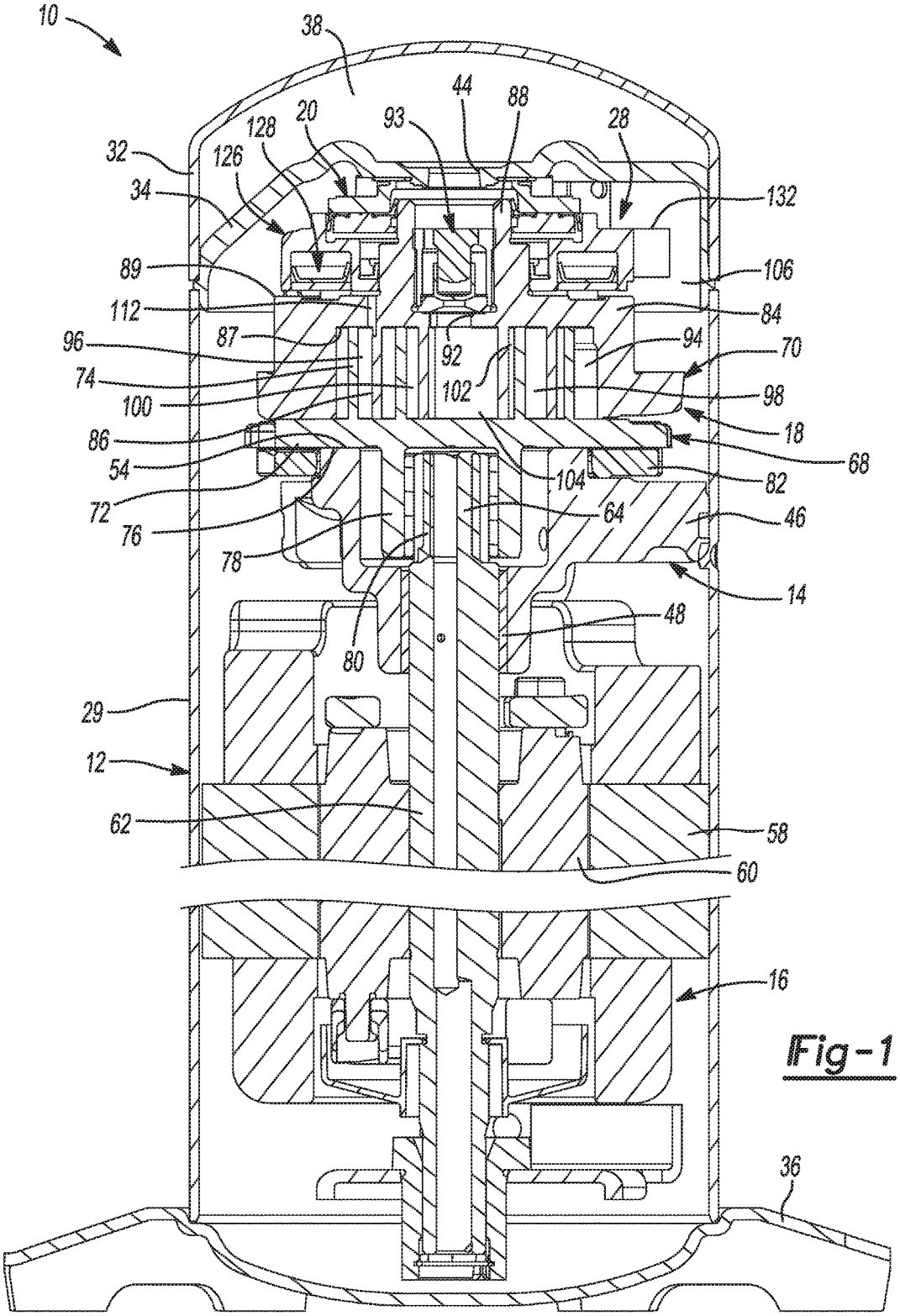
FIG. 1 is a cross-sectional view of a compressor having a capacity modulation system according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a compressor 10 is provided that may include a hermetic shell assembly 12, a bearing housing assembly 14, a motor assembly 16, a compression mechanism 18, a seal assembly 20, and a capacity modulation assembly 28. The shell assembly 12 may house the bearing housing assembly 14, the motor assembly 16, the compression mechanism 18, the seal assembly, and the capacity modulation assembly 28.

The shell assembly 12 may generally form a compressor housing and may include a cylindrical shell 29, an end cap 32 at the upper end thereof, a transversely extending partition 34, and a base 36 at a lower end thereof. The end cap 32 and partition 34 may generally define a discharge chamber 38. The discharge chamber 38 may generally form a discharge muffler for compressor 10. While the compressor 10 is illustrated as including the discharge chamber 38, the present disclosure applies equally to direct discharge configurations. A discharge fitting may be attached to the shell assembly 12 at an opening in the end cap 32. A suction gas inlet fitting may be attached to the shell assembly 12 at another opening. The partition 34 may include a discharge passage 44 therethrough providing communication between the compression mechanism 18 and the discharge chamber 38.

The bearing housing assembly 14 may be affixed to the shell 29 and may include a main bearing housing 46 and a bearing 48 disposed therein. The main bearing housing 46 may house the bearing 48 therein and may define an annular flat thrust bearing surface 54 on an axial end surface thereof.

The motor assembly 16 may generally include a motor stator 58, a rotor 60, and a driveshaft 62. The motor stator 58 may be press fit into the shell 29. The driveshaft 62 may be rotatably driven by the rotor 60 and may be rotatably supported within the bearing 48. The rotor 60 may be press fit on the driveshaft 62. The driveshaft 62 may include an eccentric crankpin 64.

The compression mechanism 18 may generally include an orbiting scroll 68 and a non-orbiting scroll 70. The orbiting scroll 68 may include an end plate 72 having a spiral wrap 74 on the upper surface thereof and an annular flat thrust surface 76 on the lower surface. The thrust surface 76 may interface with the annular flat thrust bearing surface 54 on the main bearing housing 46. A cylindrical hub 78 may project downwardly from the thrust surface 76 and may have a drive bushing 80 rotatably disposed therein. The drive bushing 80 may include an inner bore in which the crank pin 64 is drivingly disposed. A flat surface of the crankpin 64 may drivingly engage a flat surface in a portion of the inner bore of the drive bushing 80 to provide a radially compliant driving arrangement. An Oldham coupling 82 may be engaged with the orbiting and non-orbiting scrolls 68, 70 or the orbiting scroll 68 and the main bearing housing 46 to prevent relative rotation therebetween.

Figure 2:
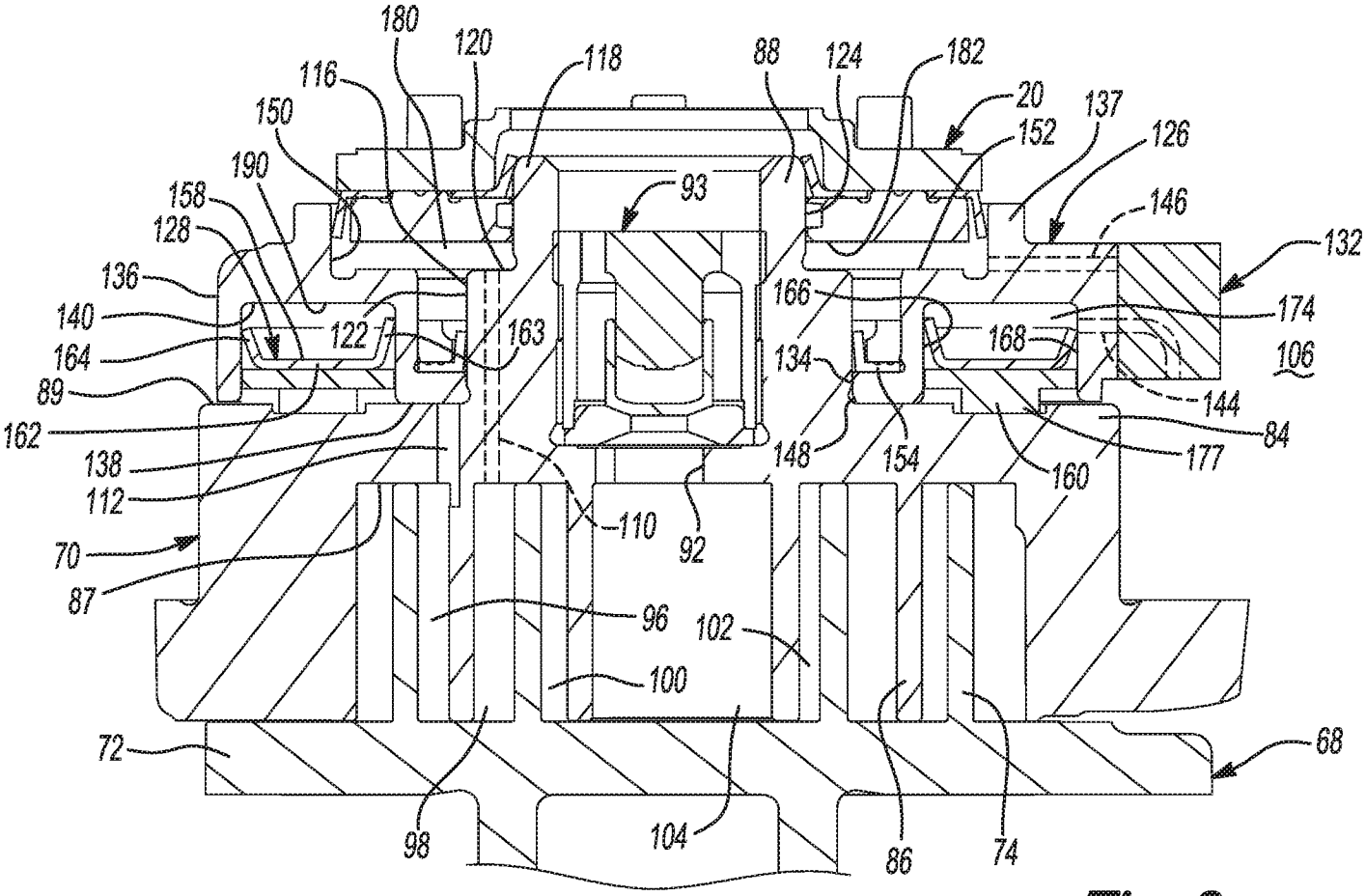
FIG. 2 is a cross-sectional view of a compression mechanism and capacity modulation system of FIG. 1 with the capacity modulation system in a full-capacity mode.
Figure 3:
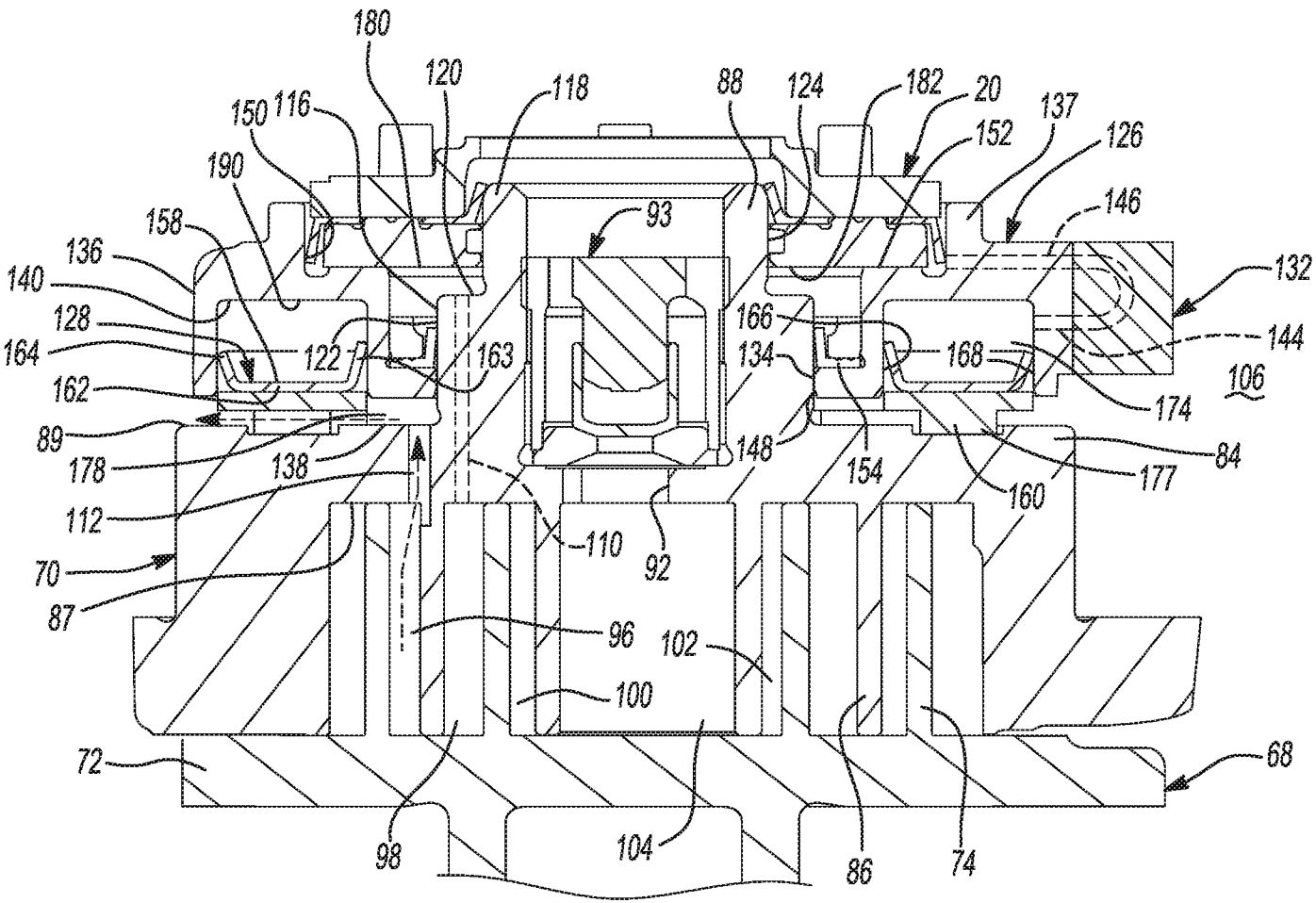
FIG. 3 is a cross-sectional view of the compression mechanism and capacity modulation system with the capacity modulation system in a reduced-capacity mode.
Figure 4:
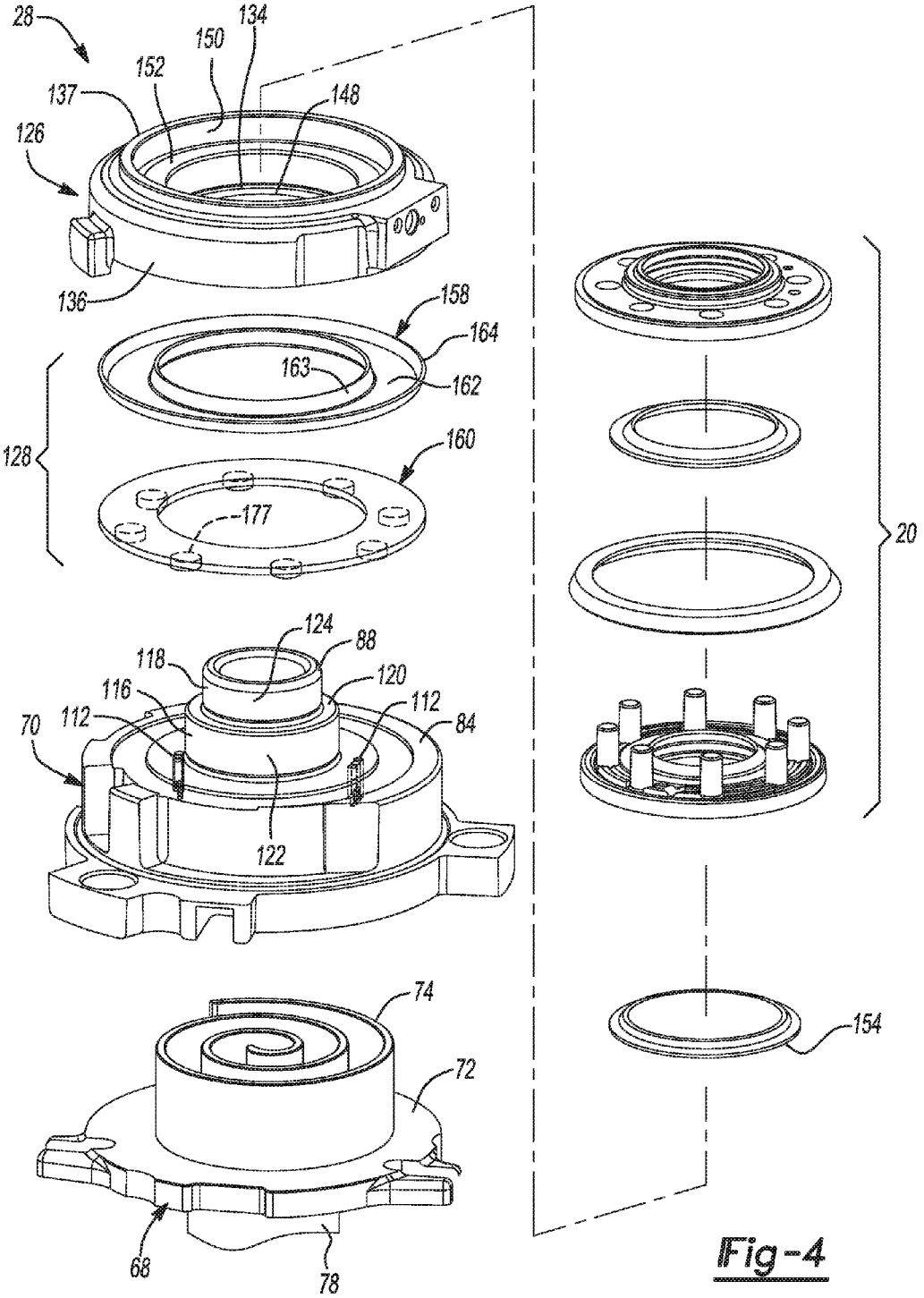
FIG. 4 is an exploded view of the compression mechanism and capacity modulation system.

With additional reference to FIGS. 2-4, the non-orbiting scroll 70 may include an end plate 84 defining a discharge passage 92 and having a spiral wrap 86 extending from a first side 87 thereof, and an annular hub 88 extending from a second side 89 thereof opposite the first side. The spiral wraps 74, 86 may be meshingly engaged with one another defining pockets 94, 96, 98, 100, 102, 104 (FIG. 1). It is understood that the pockets 94, 96, 98, 100, 102, 104 change throughout compressor operation.

A first pocket (pocket 94 in FIG. 1) may define a suction pocket in communication with a suction-pressure region 106 of the compressor 10 operating at a suction pressure ($P_s$) and a second pocket (pocket 104 in FIG. 1) may define a discharge pocket in communication with a discharge pressure region (e.g., discharge chamber 38) of the compressor 10 operating at a discharge pressure ($P_d$) via the discharge passage 92. A discharge valve assembly 93 may be disposed within or adjacent the discharge passage 92 to allow fluid flow from the discharge pocket to the discharge chamber 38 and restrict or prevent fluid flow in the opposite direction. Pockets intermediate the first and second pockets (pockets 96, 98, 100, 102 in FIG. 1) may form intermediate compression pockets operating at intermediate pressures between the suction pressure ($P_s$) and the discharge pressure ($P_d$).

Referring again to FIGS. 2-4, the end plate 84 of the non-orbiting scroll 70 may additionally include a biasing passage 110 and one or more modulation ports 112. The biasing passage 110 and modulation ports 112 may extend through the end plate 84 and may each be in fluid communication with intermediate compression pockets (e.g., pockets 96, 98, 100, 102). The biasing passage 110 may be in fluid communication with one of the intermediate compression pockets operating at a higher pressure than ones of intermediate compression pockets in fluid communication with the modulation ports 112. The biasing passage 110 may be disposed radially outward relative to the modulation ports 112.

The annular hub 88 may include first and second portions 116, 118 forming a stepped region 120 therebetween. The first portion 116 may be located axially between the second portion 118 and the end plate 84 and may have an outer radial surface 122 having a greater diameter than a diameter of an outer radial surface 124 of the second portion 118. The biasing passage 110 may extend through the annular hub 88.

The capacity modulation assembly 28 may include a modulation valve ring 126, a modulation lift ring 128, and a modulation control valve assembly 132 (FIGS. 2 and 3). The modulation valve ring 126 may include an inner radial surface 134, an outer radial surface 136, an upper rim 137, and a lower axial end surface 138 defining an annular recess 140, and first and second passages 144, 146. The inner radial surface 134 may include first and second portions 148, 150. An axially upwardly facing surface 152 (i.e., a surface facing an axial direction parallel to a rotational axis of the driveshaft 62) may be disposed between the first and second portions 148, 150. The first portion 148 may have diameter that is less than a diameter of the second portion 150. The modulation valve ring 126 may be received on the hub 88 such that the first portion 116 of the hub 88 is sealingly engaged (via seal 154) with the first portion 148 of the inner radial surface 134 of the modulation valve ring 126.

The modulation lift ring 128 may be located within annular recess 140 and may include an annular seal body 158 and a base ring 160. The modulation valve ring 126 and the modulation lift ring 128 may cooperate to define a modulation control chamber 174 disposed within the recess 140. The first passage 144 may be in fluid communication with modulation control chamber 174. The base ring 160 may support the seal body 158 and may include a series of bosses or protrusions 177 contacting the end plate 84 and defining radial flow passages 178 between the end plate 84 and the base ring 160. The base ring 160 can be formed from a metallic material, such as cast iron, for example.

The seal body 158 may be a single, unitary body formed from a polymeric material, such as Teflon®, for example. The seal body 158 may include a generally U-shaped cross section having a base portion 162, an inner lip 163 and an outer lip 164. The lips 163, 164 may be integrally formed with the base portion 162. The base portion 162 may be a generally flat, annular member that extends radially (i.e., in a direction perpendicular to the rotational axis of the driveshaft 62). The inner lip 163 may extend from a radially inner edge of the base portion 162, and the outer lip 164 may extend from a radially outer edge of the base portion 162. The inner lip 163 may extend from the base portion 162 axially upward (i.e., toward the seal assembly 20) and radially inward (i.e., toward the hub 88). The outer lip 164 may extend from the base portion 162 axially upward (i.e., toward the seal assembly 20) and radially outward (i.e., away from the hub 88). The lips 163, 164 may be sealingly engaged with respective sidewalls 166, 168 of the annular recess 140. Fluid pressure within the modulation control chamber 174 may force the lips 163, 164 into sealing contact with the sidewalls 166, 168 and keep the seal body 158 stationary while the modulation valve ring 126 moves between the positions shown in FIGS. 2 and 3.

The above configuration of the modulation lift ring 128 reduces the number of components of the capacity modulation assembly 28, simplifies assembly and installation of the capacity modulation assembly 28, and reduces material swelling that can occur in O-ring seals when refrigerant and/or oil are introduced into the compressor 10. The modulation lift ring 128 described above also improves robustness and reliability of the capacity modulation assembly 28. Furthermore, the amount that the lips 163, 164 extend upward (in an axial direction) into the recess 140 allow for sealing contact with the sidewalls 166, 168 relatively far up into the recess 140, which allows for a greater amount of axial travel of the modulation valve ring 126 relative to the modulation lift ring 128.

Figure 5:
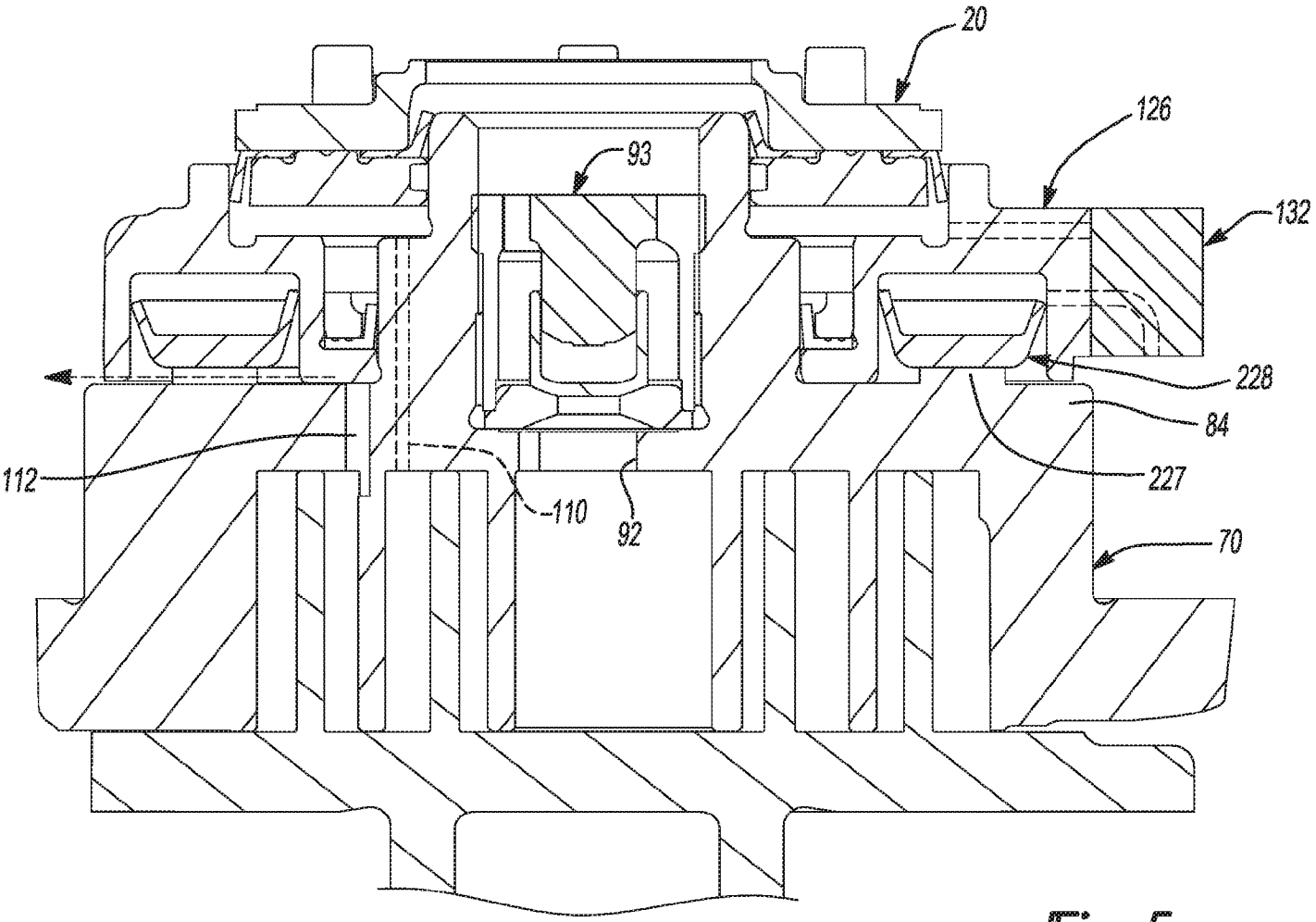
FIG. 5 is a cross-sectional view of a compression mechanism and capacity modulation system having an alternative lift ring and with the capacity modulation system in a full-capacity mode.
Figure 6:
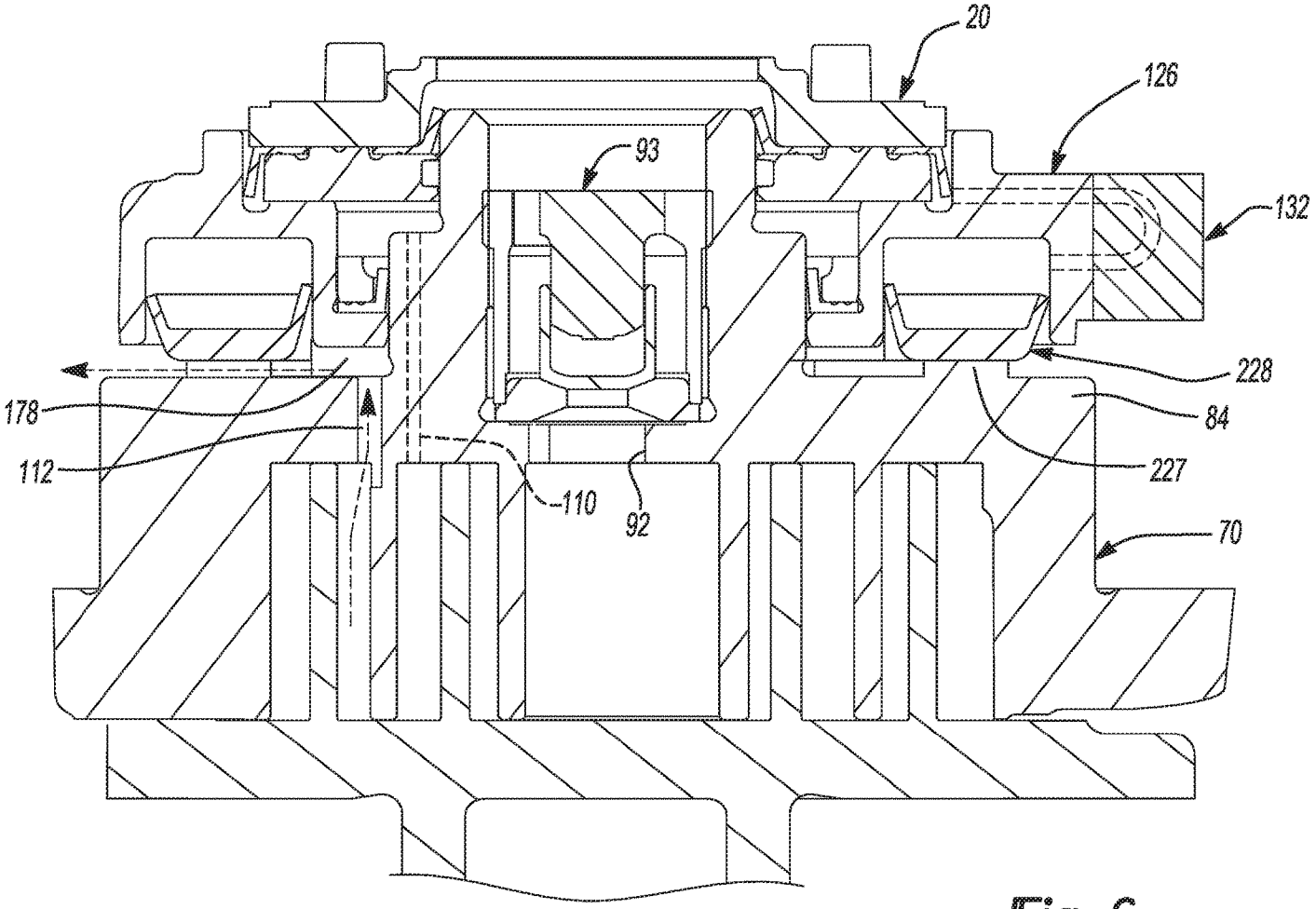
FIG. 6 is a cross-sectional view of the compression mechanism and capacity modulation system of FIG. 5 in a reduced-capacity mode.

As shown in FIGS. 5 and 6, another modulation lift ring 228 is provided that also provides at least the same benefits and advantages as the lift ring 128 described above. The lift ring 228 may be a single unitary body formed from a polymeric material. Bosses or protrusions 227 (like protrusions 177) can be integrally formed on the end plate 84 and can provide radial flow passages 178 (FIG. 6) between the end plate 84 and the lift ring 228. In other words, the base ring 160 can be integrally formed with the end plate 84. In some configurations, instead of the plurality of protrusions 227 defining the radial flow passages 178, a plurality of apertures can be cross-drilled in a single raised ring integrally formed on the end plate 84 to form the radial flow passages 178.

In other configurations, the base ring 160 and seal body 158 described above can be integrally formed as a single, unitary polymeric body having the U-shaped cross section and a plurality of protrusions contacting the end plate 84 and defining radial flow passages 178 (FIG. 3) between the end plate 84 and the lift ring 228. In some configurations, fasteners can fixedly attach the lift ring 128, 228 to the end plate 84 and/or base ring 160. In some configurations, a separate ring-shaped plate or a plurality of washers can be placed on the base portion 162 of the U-shaped seal body 158 and fasteners can extend through the ring-shaped plate (or washers), through the seal body 158 and into the base ring 160 or end plate 84 to sandwich the seal body 158 between the ring-shaped plate (or washers) and the base ring 160 or end plate 84.

It will be appreciated that the modulation valve ring 126 may be used in combination with a lift ring having a different configuration than the lift ring 128 described above. For example, the modulation valve ring 126 can be used in combination with a lift ring including an annular body with O-ring seals and integrally formed bosses extending from the annular body (e.g., like the lift ring disclosed in Assignee's commonly owned U.S. Pat. No. 8,585,382, the disclosure of which is incorporated by reference). Likewise, the lift ring 128 could be used in combination with a valve ring having a different configuration that the valve ring 126 described above.

The seal assembly 20 may form a floating seal assembly and may be sealingly engaged with the non-orbiting scroll 70 and the modulation valve ring 126 to define an axial biasing chamber 180 that communicates with the biasing passage 110. More specifically, the seal assembly 20 may be sealingly engaged with the outer radial surface 124 of the annular hub 88 and the second portion 150 of the modulation valve ring 126. The axial biasing chamber 180 may be defined axially between a lower axial end surface 182 of the seal assembly 20 and the axially upwardly facing surface 152 of the modulation valve ring 126 and the stepped region 120 of the annular hub 88. The second passage 146 may be in fluid communication with the axial biasing chamber 180.

The modulation control valve assembly 132 may include a solenoid-operated valve and may be in fluid communication with the suction-pressure region 106 and the first and second passages 144, 146 in the modulation valve ring 126. During operation of the compressor 10, the modulation control valve assembly 132 may be operated in first and second modes. FIGS. 2 and 3 schematically illustrate operation of the modulation control valve assembly 132. In the first mode, shown in FIG. 2, the modulation control valve assembly 132 may provide fluid communication between the modulation control chamber 174 and the suction-pressure region 106 via the first passage 144, thereby lowering the fluid pressure within the modulation control chamber 174 to suction pressure. With the fluid pressure within the modulation control chamber 174 at or near suction pressure, the relatively higher fluid pressure within the axial biasing chamber 180 will force the modulation valve ring 126 axially downward into contact with the end plate 84 such that the lower axial end surface 138 of the modulation valve ring 126 closes the modulation ports 112, as shown in FIG. 2.

In the second mode, shown in FIG. 3, the modulation control valve assembly 132 may provide fluid communication between the modulation control chamber 174 and the axial biasing chamber 180 via the second passage 146, thereby raising the fluid pressure within the modulation control chamber 174 to the same or similar intermediate pressure as the axial biasing chamber 180 and the intermediate pocket in communication with the axial biasing chamber 180 via the biasing passage 110. With the fluid pressure within the modulation control chamber 174 at the same intermediate pressure as the axial biasing chamber 180, the fluid pressure within the modulation control chamber 174 will force the modulation valve ring 126 axially upward relative to the end plate 84 such that the lower axial end surface 138 of the modulation valve ring 126 is spaced apart from the end plate 84 to open the modulation ports 112, as shown in FIG. 3. Furthermore, the intermediate-pressure fluid within the modulation control chamber 174 will force the modulation valve ring 126 upward such that the axially upwardly facing surface 152 of the modulation valve ring 126 will contact the lower axial end surface 182 of the seal assembly 20 and urge the seal assembly 20 axially upward against the partition 34.

The ability of the axially upwardly facing surface 152 of the modulation valve ring 126 to contact the seal assembly 20 and force the seal assembly 20 upward increases the total axial upward force that is exerted on the seal assembly 20. That is, the configuration described above adds surface area against which intermediate-pressure fluid can push the seal assembly 20 axially upward. More specifically, the surface areas against which the intermediate-pressure fluid can push the seal assembly 20 include lower axial end surface 182 of the seal assembly 20 and the portion of axially downwardly facing surface 190 of the recess 140 that is disposed radially outward relative to the outer periphery of the axial biasing chamber 180. The intermediate-pressure fluid also biases the non-orbiting scroll 70 axially toward the orbiting scroll 68.

The increase in surface area against which the intermediate-pressure fluid can push the seal assembly 20 upward allows the biasing passage 110 to be positioned such that the fluid pocket with which it communicates can be at a lower pressure (i.e., the biasing passage 110 can be located at a position that is further radially outward). Even with the lower intermediate pressure in the axial biasing chamber 180 and in the modulation control chamber 174, the increased surface area over which the lower intermediate pressure fluid can push allows for adequate total upward force against the seal assembly 20.

In addition to or instead of positioning the biasing passage 110 at a lower pressure location, the modulation ports 112 can be positioned at higher pressure locations (i.e., the modulation ports 112 can be positioned closer to the discharge passage 92). This allows for improved load matching and system efficiency (i.e., a larger capacity step between part-load capacity and full-load capacity). Furthermore, the reduced pressure in the axial biasing chamber 180 reduces the friction load between the scrolls 68, 70 (i.e., due to downward force biasing the non-orbiting scroll 70 axially against the orbiting scroll 68), thereby reducing wear on the scrolls 68, 70, while still providing sufficient sealing between the scrolls 68, 70 and between the seal assembly 20 and the partition 34. This leads to less power consumption and improved efficiency. Furthermore, the configuration of the capacity modulation assembly 28 of the present disclosure may increase the capacity step between full and reduced capacities, and may improve stability in balanced-pressure and defrost conditions during partial-load operation.

Figure 7:
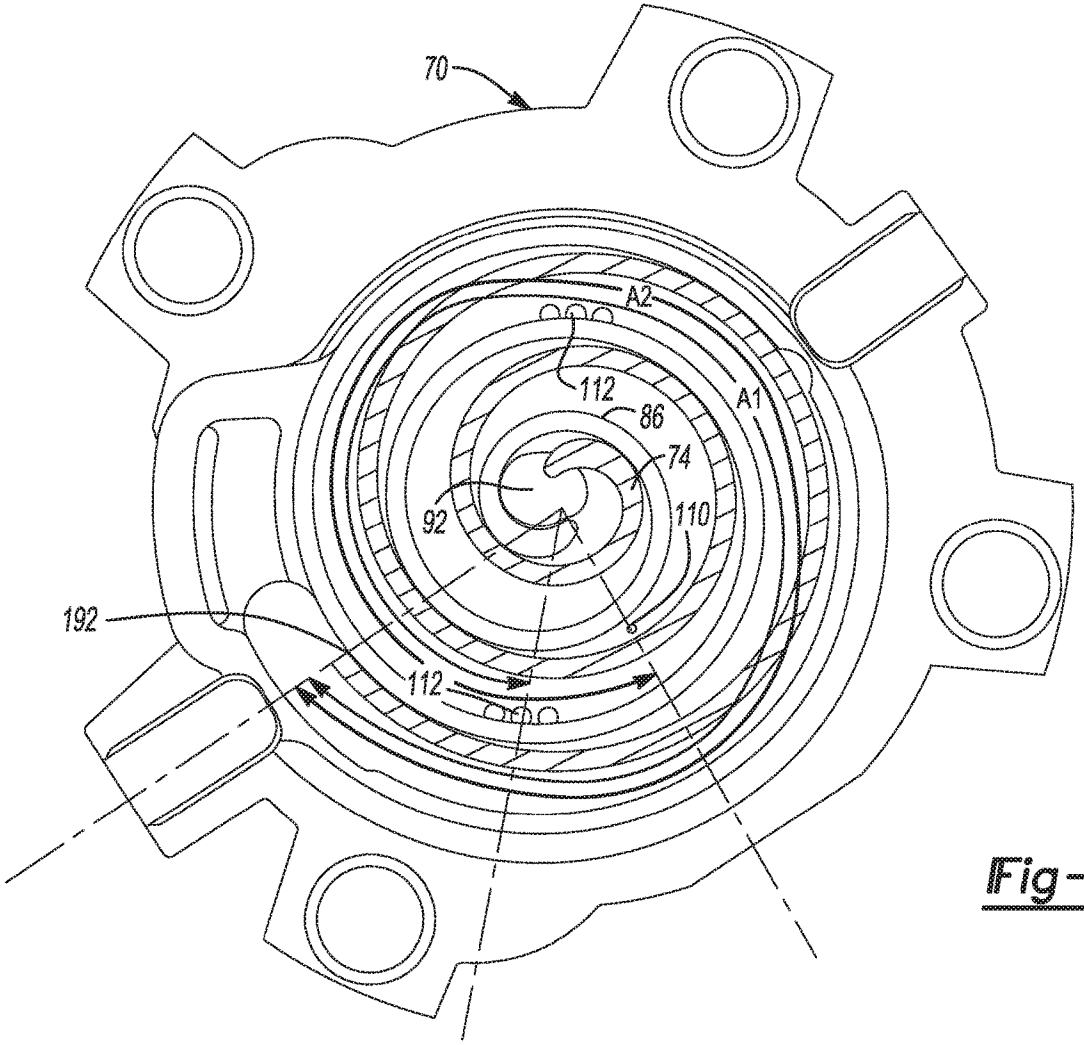
FIG. 7 is a cross-sectional view of a set of exemplary scroll members of the compressor.
Figure 8:
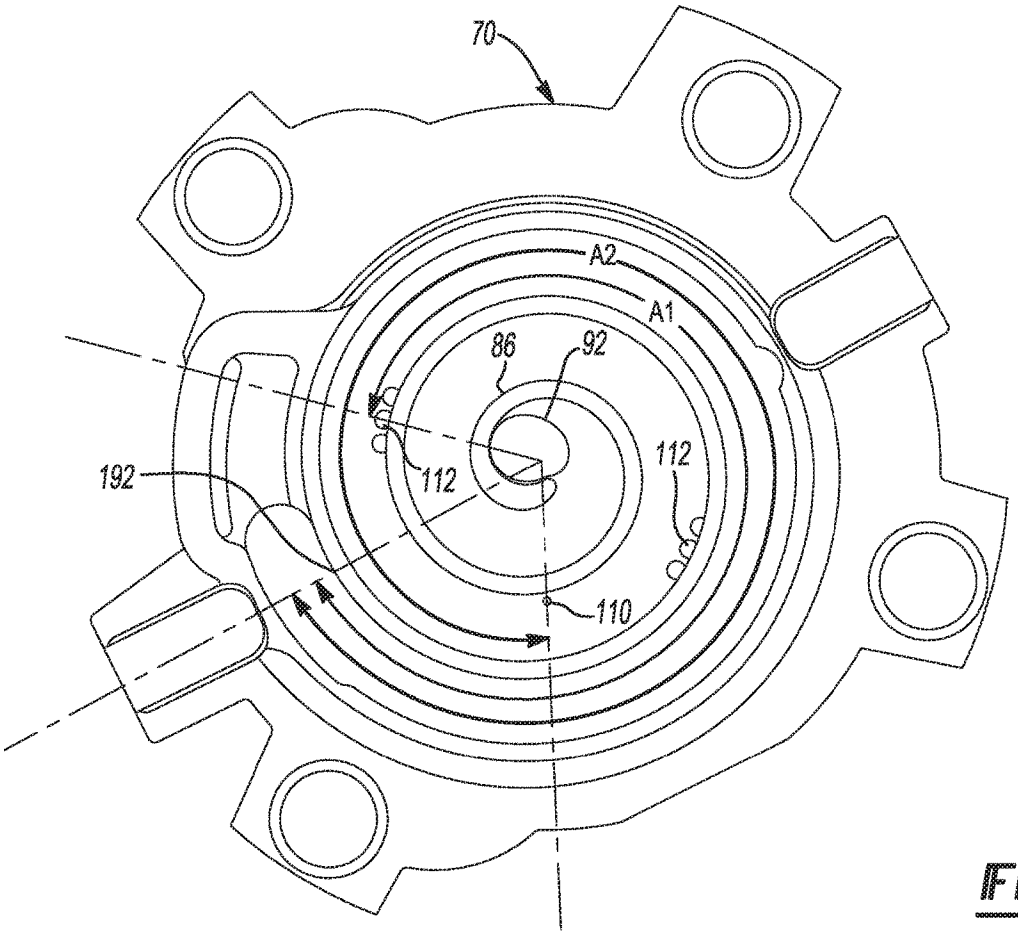
FIG. 8 is a cross-sectional view of another exemplary non-orbiting scroll member of the compressor.
Figure 9:
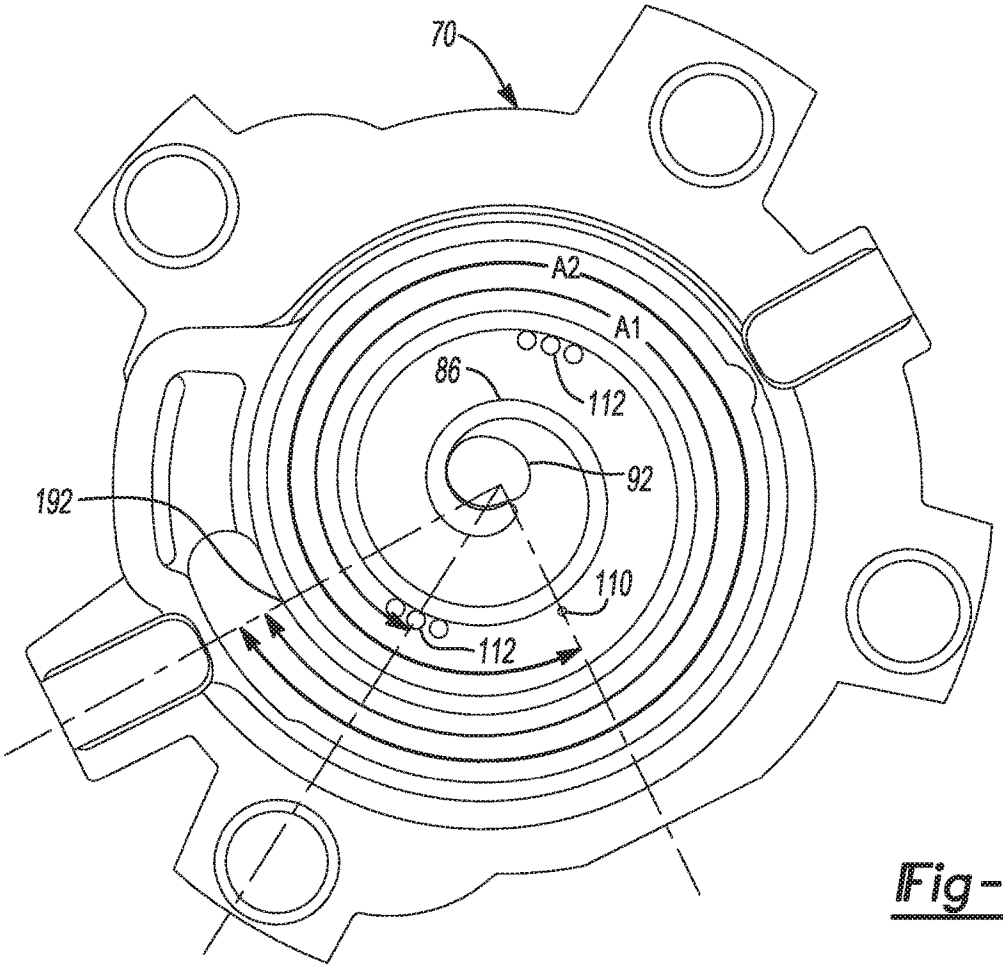
FIG. 9 is a cross-sectional view of yet another exemplary non-orbiting scroll member of the compressor.

FIGS. 7-9 depict exemplary configurations in which the position of the biasing passage 110 has been moved to lower pressure locations and/or the modulation ports 112 have been moved to higher pressure locations relative to other compressors (i.e., compressors having capacity modulation assemblies that differ from the capacity modulation assembly 28 described above). In the exemplary configurations shown in FIGS. 6-8, a ratio of angle A1 to angle A2 (A1/A2) may be between about 0.65 and 0.75. Angle A1 may be a wrap angle between a suction seal-off location 192 (i.e., the radially outermost location at which the wrap 86 of the non-orbiting scroll 70 and the wrap 74 of the orbiting scroll 68 contact each other to initially seal off a pocket between the wraps 74, 86) and a selected one of the modulation ports 112. Angle A2 may be a wrap angle between the suction seal-off location 192 and the biasing passage 110.

In some configurations, the ratio of angle A1 to angle A2 may be between 0.66 and 0.73. In some configurations, the ratio of angle A1 to angle A2 may be between 0.71 and 0.73. In some configurations, the ratio of angle A1 to angle A2 may be between 0.66 and 0.69.

Figure 10:
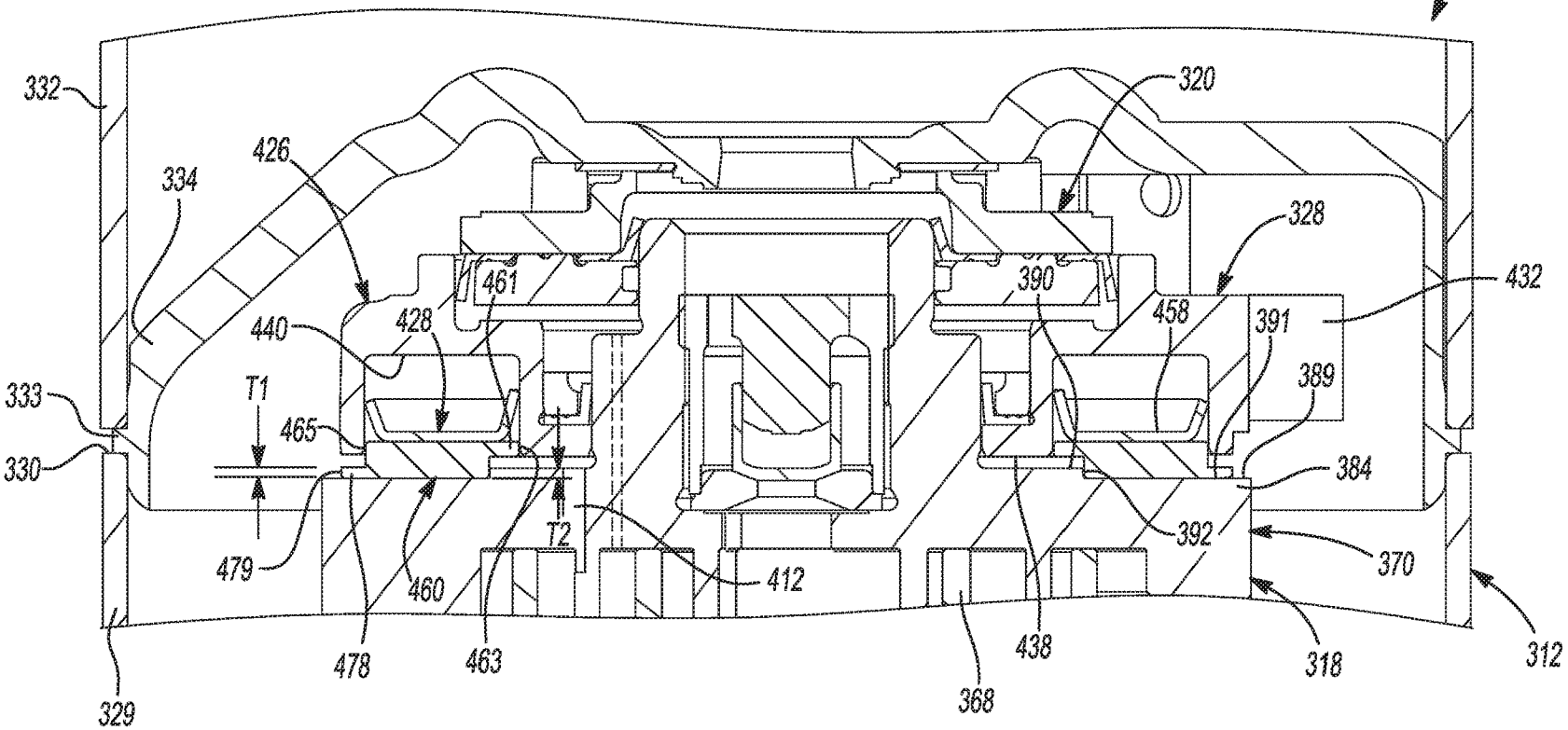
FIG. 10 is a partial cross-sectional view of another compressor having another capacity modulation system with a base ring installed correctly within the compressor according to the principles of the present disclosure.
Figure 11:
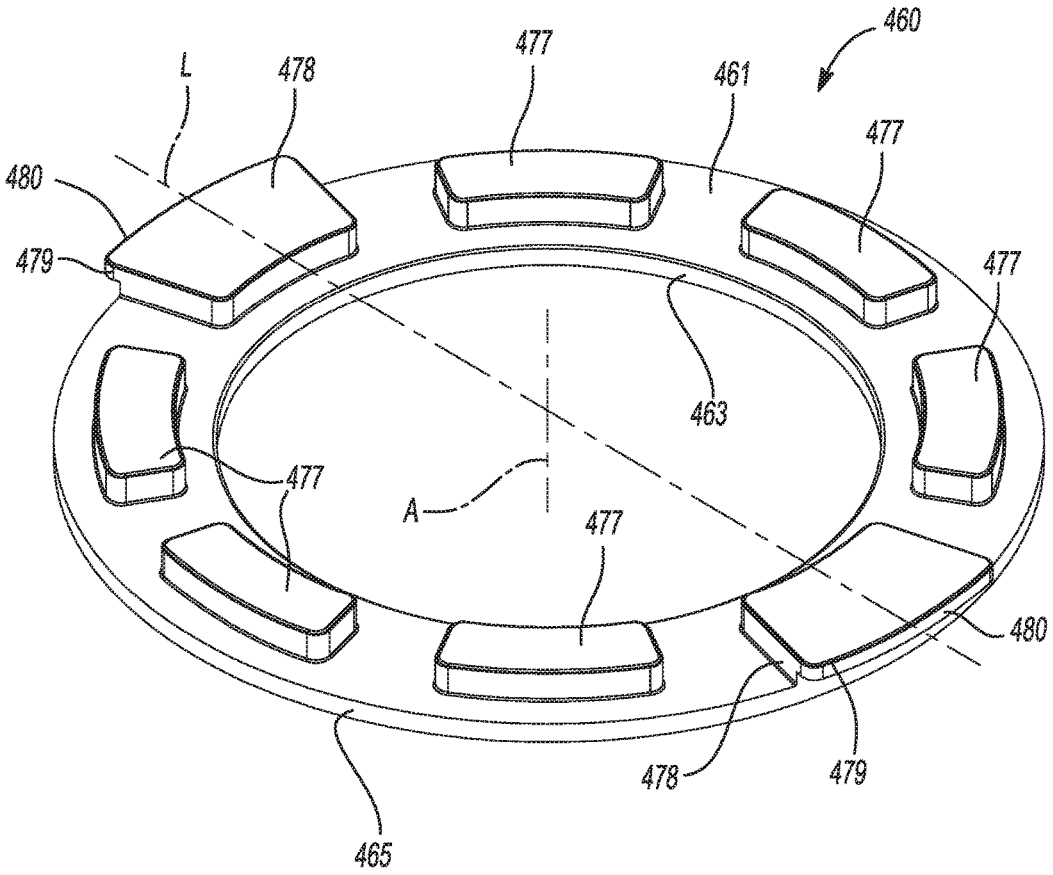
FIG. 11 is a perspective view of the base ring of FIG. 10.
Figure 12:
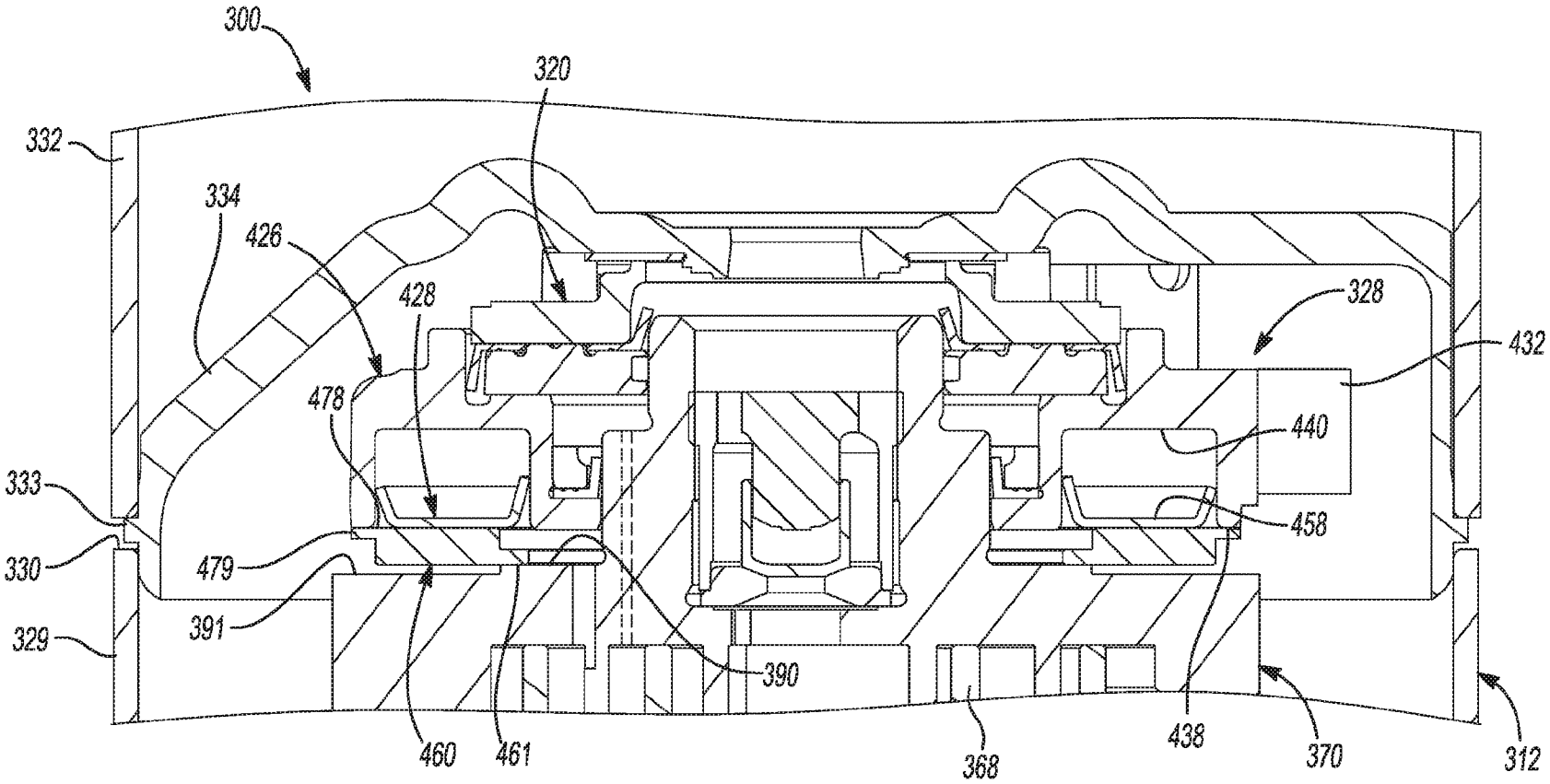
FIG. 12 is a partial cross-sectional view of the compressor of FIG. 10 with the base ring installed incorrectly.

Referring now to FIGS. 10-12, another compressor 300 (partially shown in FIGS. 10 and 12) is provided that may include a shell assembly 312, a bearing housing assembly (not shown), a motor assembly (not shown), a compression mechanism 318, a seal assembly 320, and a capacity modulation assembly 328. The structure and function of the shell assembly 312, bearing housing assembly, motor assembly and seal assembly 320 may be similar or identical to that of the shell assembly 12, bearing housing assembly 14, motor assembly 16 and seal assembly 20 described above, and therefore, will not be described again in detail.

Like the compression mechanism 18, the compression mechanism 318 includes an orbiting scroll 368 and a non-orbiting scroll 370. The structure and function of the orbiting scroll 368 may be similar or identical to that of the orbiting scroll 68 described above, and therefore, will not be described again in detail. The structure and function of the non-orbiting scroll 370 may be similar or identical to that of the non-orbiting scroll 70 described above, apart from any exceptions described below. Therefore, similar features will not be described again in detail.

As shown in FIG. 10, a second side 389 of an end plate 384 of the non-orbiting scroll 370 may include a first annular surface 390 and a second annular surface 391 surrounding the first annular surface 390. The end plate 384 may include an annular step 392 disposed radially between and directly adjacent the first and second annular surfaces 390, 391. In this manner, the first and second annular surfaces 390, 391 define first and second planes that are parallel and axially offset from each other (i.e., offset in a direction parallel to a rotational axis of a driveshaft of the compressor 300). The second annular surface 391 may be disposed axially between the first annular surface 390 and the orbiting scroll 368. One or more modulation ports 412 (similar or identical to modulation port(s) 112) may extend through the first annular surface 390.

The structure and function of the capacity modulation assembly 328 may be similar or identical to that of the capacity modulation assembly 28 described above, apart from any exceptions described below. Therefore, similar features will not be described again in detail. Like the capacity modulation assembly 28, the capacity modulation assembly 328 may include a modulation valve ring 426 (similar or identical to the modulation valve ring 126), a modulation lift ring 428, and a modulation control valve assembly 432 (similar or identical to the modulation control valve assembly 132). The modulation valve ring 426 may be spaced apart from the first annular surface 390 of the non-orbiting scroll 370 in one position (shown in FIG. 10) to allow fluid flow through the modulation port 412. The modulation valve ring 426 may contact the first annular surface 390 in another position (not shown; like the position shown in FIG. 2) to restrict or prevent fluid flow through the modulation port 412.

The modulation lift ring 428 may include an annular seal body 458 (similar or identical to the annular seal body 158) and a base ring 460. The modulation lift ring 428 provides at least the same benefits and advantages as the lift ring 128 described above.

As shown in FIG. 11, the base ring 460 may include a main body 461, a plurality of first protrusions or bosses 477, and a plurality of second protrusions or bosses 478. When the modulation valve ring 426 is in the position shown in FIG. 10 position allowing fluid flow through the modulation port 412, the fluid from the modulation port 412 may flow between the main body 461 and the end plate 384 (through the spaces between adjacent bosses 477, 478). The main body 461 may be an annular disk having inner and outer diametrical surfaces 463, 465 that are sized so that the main body 461 can fit within an annular recess 440 in the modulation valve ring 426. The inner diametrical surface 463 defines an inner diameter of the main body 461 that is smaller than a diameter defined by the annular step 392 of the non-orbiting scroll 370.

When the base ring 460 is installed in the compressor 300 correctly (as shown in FIG. 10), the first and second bosses 477, 478 may contact the second annular surface 391 of the non-orbiting scroll 370. The first bosses 477 may be radially disposed entirely between the inner and outer diametrical surfaces 463, 465 of the main body 461. Each of the second bosses 478 includes a flange portion 479 that extends radially outward beyond the outer diametrical surface 465 of the main body 461. In some configurations, the first bosses 477 could have the same size and shape as the second bosses 478.

In the configuration shown in FIG. 11, the two second bosses 478 are disposed 180 degrees apart from each other. A distance between radially outer edges 480 of the two second bosses 478 (i.e., a distance along a line L that intersects and is perpendicular to an axis A of angular of rotational symmetry of the main body 461) is greater than an outer diameter of the annular recess 440 of the modulation valve ring 426. As shown in FIG. 10, an axial thickness T1 of the flange portion 479 (i.e., a thickness in a direction parallel to the axis A and the rotational axis of the driveshaft) is less than an axial thickness T2 of the annular step 392. In this manner, regardless of the axial position of the modulation valve ring 426, the axial distance between the first annular surface 390 of the non-orbiting scroll 370 and a lower axial end surface 438 of the modulation valve ring 426 is less than the axial distance between the flange portion 479 and the lower axial end surface 438. In other words, the axial thickness T1 of the flange portion 479 is sized so that, as long as the base ring 460 is installed correctly (as shown in FIG. 10), the flange portions 479 will not prevent the modulation valve ring 426 from moving along its entire range of motion.

As shown in FIG. 12, if the base ring 460 is inadvertently installed upside down onto the non-orbiting scroll 370, the flange portions 479 of the second bosses 478 will contact the lower axial end surface 438 of the modulation valve ring 426, and the main body 461 will contact the first annular surface 390 of the non-orbiting scroll 370. Such contact between the flange portions 479 and the modulation valve ring 426 will prevent the modulation valve ring 426 from being positioned close enough to the first annular surface 390 to allow clearance for a mounting tab or rib 333 of a partition 334 of the shell assembly 312 from seating on an axial end 330 of a cylindrical shell 329 of the shell assembly 312. In other words, when the base ring 460 is installed in the compressor 300 incorrectly (i.e., upside down), a stack-up of the base ring 460, the modulation valve ring 426, and the floating seal assembly 320 prevent the partition 334 and end cap 332 of the shell assembly 312 from being lowered onto the cylindrical shell 329, thereby preventing the partition 334 and end cap 332 from being welded onto the cylindrical shell 329 and preventing the shell assembly 312 from being sealed shut.

In this manner, the structure of the base ring 460 is a poka-yoke structure that prevents the shell assembly 312 from being welded shut while the base ring 460 is installed incorrectly. Therefore, if the base ring 460 is inadvertently installed upside down, the manufacturer will realize that there has been an assembly error before the shell assembly 312 can be sealed shut. In other capacity modulation assemblies, the shell assembly is capable of being fully assembled and welded shut without the manufacturer realizing that the base ring is installed upside down. Such upside down installation of the base ring can prevent the capacity modulation assembly from functioning properly (e.g., the modulation valve ring is prevented from moving into a full-capacity position in which the modulation valve ring closes off the modulation port in the non-orbiting scroll).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell assembly defining a suction-pressure region and a discharge-pressure region, the shell assembly including a partition separating the suction-pressure region from the discharge-pressure region;

a first scroll member disposed within the shell assembly and including a first end plate having a discharge passage, a modulation port, a biasing passage, and a first spiral wrap extending from the first end plate;

a second scroll member disposed within the shell assembly and including a second end plate having a second spiral wrap extending therefrom, the first and second spiral wraps meshingly engaged and forming a series of pockets during orbital displacement of the second scroll member relative to the first scroll member, the modulation port in communication with a first one of the pockets, the biasing passage in communication with a second one of the pockets;

a floating seal assembly engaged with the partition and the first scroll member and isolating the discharge-pressure region from the suction-pressure region;

a modulation valve ring located axially between the floating seal assembly and the first end plate and being in sealing engagement with an outer radial surface of a hub extending from the first end plate and an outer radial surface of the floating seal assembly to define an axial biasing chamber in fluid communication with the biasing passage, the modulation valve ring being axially displaceable between first and second positions, the modulation valve ring abutting the first end plate and closing the modulation port when in the first position, the modulation valve ring is spaced apart from the first end plate to open the modulation port when in the second position; and a modulation lift ring located axially between the modulation valve ring and the first end plate and in sealing engagement with the modulation valve ring to define a modulation control chamber between the modulation valve ring and the modulation lift ring, the modulation lift ring including a seal having a U-shaped cross section formed from a polymeric material and engaging first and second annular walls of the modulation valve ring.

2. The compressor of claim 1, wherein the modulation lift ring includes a base ring disposed axially between the U-shaped cross section and the first end plate, the base ring includes a plurality of axially extending bosses contacting the first end plate and defining a radially extending passage between the modulation lift ring and first end plate.

3. The compressor of claim 2, wherein the base ring includes an annular main body from which the bosses extend, wherein the main body is at least partially received within an annular recess in the modulation valve ring, and wherein each of at least two of the bosses includes a flange portion that extends radially outward relative to an outer diametrical surface of the main body and radially outward relative to the annular recess.

4. The compressor of claim 1, wherein the modulation valve ring abuts an axially-facing surface of the floating seal assembly and urges the floating seal assembly axially against the partition when in the second position.

5. The compressor of claim 1, further comprising a modulation control valve assembly operable in first and second modes and in fluid communication with the modulation control chamber, the modulation control valve assembly controlling an operating pressure within the modulation control chamber, wherein the modulation control valve assembly provides a first pressure within the modulation control chamber when operated in the first mode to displace the modulation valve ring to the first position and operate the compressor in a full capacity mode, and wherein the modulation control valve assembly provides a second pressure within the modulation control chamber greater than the first pressure when operated in the second mode to displace the modulation valve ring to the second position and operate the compressor in a partial capacity mode.

6. The compressor of claim 5, wherein a radially extending passage is formed axially between the modulation valve ring and the first end plate when the modulation valve ring is in the second position, and wherein the radially extending passage is in communication with the modulation port.

7. The compressor of claim 6, wherein the radially extending passage extends between the modulation lift ring and the first end plate.

8. The compressor of claim 1, wherein the modulation port is located at a first wrap angle from a suction seal-off location, and the biasing passage is located at a second wrap angle from the suction seal-off location, and wherein a ratio of the first angle to the second angle is between 0.65 and 0.75.

9. A compressor comprising:

a first scroll member including a first end plate having a discharge passage, a port, a biasing passage, and a first spiral wrap extending from the first end plate;

a second scroll member including a second end plate having a second spiral wrap extending therefrom, the first and second spiral wraps meshingly engaged and forming a series of pockets therebetween, the port in selective communication with one of the pockets, the biasing passage in communication with one of the pockets;

a seal assembly engaged with the first scroll member and a partition defining a discharge chamber of the compressor; and a valve ring located axially between the seal assembly and the first end plate and cooperating with the seal assembly to define an axial biasing chamber in fluid communication with the biasing passage, the valve ring being movable between a first position in which the valve ring abuts the first end plate and closes the port and a second position in which the valve ring is spaced apart from the first end plate to open the port, a lift ring located axially between the valve ring and the first end plate and in sealing engagement with the valve ring to define a control chamber between the valve ring and the lift ring, the lift ring including a seal having a U-shaped cross section formed from a polymeric material and engaging first and second annular walls of the valve ring.

10. The compressor of claim 9, wherein the U-shaped cross section includes a base portion and a pair of lips formed integrally with the base portion, one of the lips extends from a radially outer edge of the base portion, another of the lips extends from a radially inner edge of the base portion.

11. The compressor of claim 10, wherein the first end plate includes a plurality of axially extending bosses integrally formed with the first end plate and contacting the lift ring to define a radially extending passage in communication with the port.

12. The compressor of claim 9, wherein the valve ring abuts an axially-facing surface of the seal assembly and urges the seal assembly axially against the partition when in the second position.

13. The compressor of claim 9, further comprising a control valve assembly operable in first and second modes and in fluid communication with the control chamber, the control valve assembly controlling an operating pressure within the control chamber, wherein the control valve assembly provides a first pressure within the control chamber when operated in the first mode to displace the valve ring to the first position and operate the compressor in a full capacity mode, and wherein the control valve assembly provides a second pressure within the control chamber greater than the first pressure when operated in the second mode to displace the valve ring to the second position and operate the compressor in a partial capacity mode.

14. The compressor of claim 13, wherein a radially extending passage is formed axially between the valve ring and the first end plate when the valve ring is in the second position, and wherein the radially extending passage is in communication with the port and extends between the lift ring and the first end plate.

15. The compressor of claim 14, wherein the port is located at a first wrap angle from a suction seal-off location, and the biasing passage is located at a second wrap angle from the suction seal-off location, and wherein a ratio of the first angle to the second angle is between 0.65 and 0.75.

16. The compressor of claim 9, wherein the lift ring includes a base ring including a plurality of axially extending bosses contacting the first end plate.

17. The compressor of claim 16, wherein the base ring includes an annular main body from which the bosses extend, wherein the main body is at least partially received within an annular recess in the valve ring, and wherein each of at least two of the bosses includes a flange portion that extends radially outward relative to an outer diametrical surface of the main body and radially outward relative to the annular recess.

18. The compressor of claim 17, wherein the first end plate includes a first annular surface, a second annular surface, and an annular step disposed between the first and second annular surfaces, wherein the valve ring contacts the first annular surface when the valve ring is in the first position, and wherein the bosses contact the second annular surface.

19. The compressor of claim 18, wherein an axial thickness of the flange portion is less than an axial thickness of the annular step, and wherein an inner diameter of the main body is less than a diameter of the annular step.

20. A compressor comprising:

a first scroll member including a first end plate having a discharge passage, a port, a biasing passage, and a first spiral wrap extending from the first end plate;

a second scroll member including a second end plate having a second spiral wrap extending therefrom, the first and second spiral wraps meshingly engaged and forming a series of pockets therebetween, the port in selective communication with one of the pockets, the biasing passage in communication with one of the pockets;

a seal assembly engaged with the first scroll member and a partition defining a discharge chamber of the compressor; and a valve ring located axially between the seal assembly and the first end plate and cooperating with the seal assembly to define an axial biasing chamber in fluid communication with the biasing passage, the valve ring being movable between a first position in which the valve ring abuts the first end plate and closes the port and a second position in which the valve ring is spaced apart from the first end plate to open the port, a lift ring at least partially disposed within an annular recess in the valve ring and in sealing engagement with the valve ring to define a control chamber between the valve ring and the lift ring, the lift ring including a base ring having a plurality of bosses contacting the first end plate, the base ring including an annular main body from which the bosses extend, wherein the main body is at least partially received within the annular recess, and wherein each of at least two of the bosses includes a flange portion that extends radially outward relative to an outer diametrical surface of the main body and radially outward relative to the annular recess.

21. The compressor of claim 20, wherein the first end plate includes a first annular surface, a second annular surface, and an annular step disposed between the first and second annular surfaces, wherein the valve ring contacts the first annular surface when the valve ring is in the first position, and wherein the bosses contact the second annular surface.

22. The compressor of claim 21, wherein an axial thickness of the flange portion is less than an axial thickness of the annular step, and wherein an inner diameter of the main body is less than a diameter of the annular step.

23. The compressor of claim 22, wherein the lift ring including a seal having a U-shaped cross section formed from a polymeric material and engaging first and second annular walls of the valve ring.

* * * * *